US006851921B2

(12) United States Patent
Haag

(10) Patent No.: US 6,851,921 B2
(45) Date of Patent: Feb. 8, 2005

(54) AUTOMATED PARKING GARAGE

(76) Inventor: Gerhard Haag, 12812 N. 60th St., Clearwater, FL (US) 33760

( * ) Notice: Subject to any disclaimer, the term of this patent is extended or adjusted under 35 U.S.C. 154(b) by 130 days.

(21) Appl. No.: 10/133,557

(22) Filed: Apr. 27, 2002

(65) Prior Publication Data

US 2002/0164234 A1 Nov. 7, 2002

Related U.S. Application Data

(60) Continuation-in-part of application No. 09/790,460, filed on Feb. 22, 2001, now abandoned, and a continuation-in-part of application No. 09/364,934, filed on Jul. 30, 1999, now abandoned, which is a division of application No. 09/364, 934, filed on Jul. 30, 1999, now abandoned.

(51) Int. Cl.[7] ..... B65G 1/00

(52) U.S. Cl. ..... 414/800; 414/227; 414/234; 414/264

(58) Field of Search ..... 414/800, 227, 414/234, 236, 239, 240, 241, 246, 261, 264, 790.2, 795.3, 798, 798.1

(56) References Cited

U.S. PATENT DOCUMENTS

| | | | | | |
|---|---|---|---|---|---|
| 1,874,859 | A | * | 8/1932 | Been | 414/246 |
| 5,018,926 | A | * | 5/1991 | Sternad | 414/253 |
| 5,314,284 | A | * | 5/1994 | Tsai | 414/234 |
| 5,331,781 | A | * | 7/1994 | Gilbert | 52/143 |
| 5,338,145 | A | * | 8/1994 | Beretta | 414/254 |
| 5,467,561 | A | | 11/1995 | Takaoka | |
| 5,573,364 | A | * | 11/1996 | Schneider et al. | 414/234 |
| 5,669,753 | A | * | 9/1997 | Schween | 414/800 |
| 5,678,972 | A | * | 10/1997 | Bockler et al. | 414/239 |
| 5,810,539 | A | * | 9/1998 | Zhang et al. | 414/239 |
| 5,868,540 | A | * | 2/1999 | Hirose et al. | 414/234 |
| 6,048,156 | A | | 4/2000 | Huang | |
| 6,077,017 | A | | 6/2000 | Durant | |
| 6,325,586 | B1 | | 12/2001 | Loy | |
| 6,332,743 | B1 | | 12/2001 | Park et al. | |
| 6,501,391 | B1 | | 12/2002 | Racunas, Jr. | |
| 6,502,011 | B2 | | 12/2002 | Haag | |

FOREIGN PATENT DOCUMENTS

| | | | | | |
|---|---|---|---|---|---|
| DE | 4203118 | A1 | * | 5/1993 | B65G/47/90 |
| EP | 0351374 | A1 | * | 1/1990 | E04H/6/24 |
| GB | 2183619 | A | * | 10/1987 | E04H/6/12 |
| GB | 2224498 | A | * | 5/1990 | G07F/11/16 |

OTHER PUBLICATIONS

International Search Report mailed Jul. 1, 2004 related to PCT/US03/28171 filed Sep. 9, 2003.

* cited by examiner

*Primary Examiner*—Eileen D. Lillis
*Assistant Examiner*—Michael Lowe
(74) *Attorney, Agent, or Firm*—Tucker Ellis & West LLP

(57) ABSTRACT

An automated parking garage. The garage comprises a multi-floor building having a plurality of vehicle storage racks in a storage area for storing a loaded pallet or an unloaded pallet. An entrance-level floor of the building includes an entry/exit station (EES) on for receiving a vehicle, the EES having an exterior entrance through which the vehicle is driven and, an opposing interior entrance that provides access to the storage area and through which the loaded pallet is transported, the loaded pallet and unloaded pallet adapted to be positioned at floor level in the EES. The garage includes a pallet stacking station for storing the unloaded pallet, the pallet stacking station located over a shuttle aisle that extends under the EES. A pallet shuttle that traverses the shuttle aisle to a first position under the EES for handling the unloaded pallet in the EES, and to a second position under the pallet stacking station for stacking the unloaded pallet. The garage also includes a transport system for transporting the loaded pallet in the storage area.

29 Claims, 16 Drawing Sheets

AUTOMATED PARKING GARAGE

This application is a Continuation-in-Part of the following U.S. patent applications: Ser. No. 09/364,934 entitled "METHOD AND APPARATUS FOR DISTRIBUTING AND STORING PALLETS IN AN AUTOMATED PARKING STRUCTURE" filed Jul. 30, 1999 now Abandoned; and Ser. No. 09/790,460 entitled "METHOD AND APPARATUS FOR DISTRIBUTING AND STORING PALLETS IN AN AUTOMATED PARKING STRUCTURE" filed Feb. 22, 2001 now abandoned, which is a Divisional of the abovementioned Ser. No. 09/364,934, filed Jul. 30, 1998, now abandoned, the contents of both that are herein incorporated by reference.

BACKGROUND OF THE INVENTION

1. Technical Field of the Invention

This invention is related to automated vehicle parking garages and associated systems.

2. Background of the Related Art

Automated parking garage systems have been employed since the late 1950's utilizing crane systems, conveyors, hydraulics and pneumatics to transport and store vehicles within a parking structure. Recently, more advanced garage systems have been developed which include computer-controlled, specialized equipment for carrying vehicles to assigned parking spaces in a way similar to the way that computerized assembly lines or warehouses store and retrieve miscellaneous goods. In such assembly line and warehouse systems, a computer assigns a location for each item as it is received from its manufacturer, and robotic equipment carries each item to its assigned location. The same equipment is dispatched to the location when the item requires retrieval. Often, the items stored in a warehouse are placed on pallets to facilitate transportation and storage of the items. The use of pallets as supporting elements for the transport and storing of vehicles is also typical of more advanced automated parking garage systems.

Examples of automated parking garage systems are described in U.S. Pat. No. 5,467,561 of Takaoka, U.S. Pat. No. 5,556,246 of Broshi, U.S. Pat. No. 5,573,364 of Schneider et al., and U.S. Pat. No. 5,669,753 of Schween.

Automated parking garage systems typically utilize one of two methods to store and retrieve vehicles. A first prior art method employs pallets and assigns a separate pallet to each vehicle storage bay. In such systems, when a vehicle is to be parked or stored in a storage bay, the pallet associated with the storage bay is transported from the storage bay to the garage entrance where the vehicle is located. The vehicle is loaded onto the pallet and the pallet carrying the vehicle is transported to the storage bay where both the pallet and vehicle are stored until retrieved.

When a stored vehicle is to be retrieved, the pallet carrying the vehicle is transported from the storage bay to a garage exit. The vehicle is then unloaded from the pallet, and the pallet is transported back to the storage bay until it is needed again to store a vehicle.

Although the first prior art method accomplishes the function of transporting vehicles to and from assigned storage bays, it has significant shortcomings. A first shortcoming is the inefficient use of time when storing or retrieving a vehicle. Using the first prior art method, a driver parking a vehicle is required to idly wait while a pallet is delivered to the garage entrance from an assigned storage bay. Although garages may provide a limited pallet buffer (e.g., five pallets), it is not enough to handle the queues that may occur during periods of high volume business, such as in the morning and afternoon.

A second shortcoming is that the first prior art method of handling empty pallets impedes the throughput of the garage and fails to provide an endless, continuing and timely stream of pallets.

A further shortcoming of the first prior art automated parking method is that handling empty pallets impedes the primary purpose of an automated parking garage, that is, the storing and retrieving of vehicles. Specifically, the same equipment that is used to store and retrieve vehicles is utilized to handle empty pallets thereby promoting inefficient utilization of that equipment.

Yet another significant shortcoming of the first method is that it can only handle one vehicle and one procedure at a time. Thus, systems employing the first prior art method cannot park an incoming vehicle at the same time they are retrieving an empty pallet, and vice versa. As a result, an unacceptably long queue often forms at the entrance of such a garage during periods of high volume business.

According to the second prior art method, a single carrier module is used to service all storage bays without the use of pallets. In such systems, the module is stored at an idle position in an aisle of the garage when it is not in use. When a vehicle is to be parked or stored in a storage bay, the vehicle is loaded from an entry/exit station onto the module. The module carrying the vehicle is transported to the storage bay where the vehicle is unloaded. The empty module is transported back to the idle position while the vehicle remains stored until it is retrieved. Typically, the vehicle is loaded/unloaded to/from the module using either the vehicle's own drive system or a crane that traverses the aisles and reaches from the foundation to the roof.

When a stored vehicle is to be retrieved, the module is transported from the garage entrance to the storage bay in which the vehicle is stored. The vehicle is loaded onto the module and the module carrying the vehicle is transported to the garage exit. The vehicle is then unloaded from the module, and the empty module is transported to the garage idle position where it remains until it is needed to store or retrieve a vehicle.

Although the second prior art method eliminates the need to handle empty pallets, it has several shortcomings. Specifically, it requires excessive handling of the vehicle such as grabbing the tires in one way or another. The second prior art method also makes inefficient use of time when storing and retrieving a vehicle. Further, using the second prior art method puts vehicles at risk for being soiled during transportation (such as by oil or hydraulic fluid from the crane).

Accordingly, there is a need for an automated parking garage system that addresses the shortcomings of the prior art. Specifically, there is a need for a system that delivers a pallet to an incoming vehicle driver before or shortly after the driver's vehicle enters an automated parking garage. Further, there is a need for a system that reduces the time required to retrieve a stored vehicle. There is still a further need for a system handling empty pallets that does not utilize or otherwise impede the equipment used to store and retrieve vehicles. There is yet a further need for a garage system that provides throughput sufficient to service garage customers during periods of high volume business.

SUMMARY OF THE INVENTION

The present invention disclosed and claimed herein, in one aspect thereof, comprises an automated parking garage.

The garage comprises a multi-floor building having a plurality of vehicle storage racks in a storage area for storing a loaded pallet or an unloaded pallet. An entrance-level floor of the building includes an entry/exit station (EES) on for receiving a vehicle, the EES having an exterior entrance through which the vehicle is driven and, an opposing interior entrance that provides access to the storage area and through which the loaded pallet is transported, the loaded pallet and unloaded pallet adapted to be positioned at floor level in the EES. The garage includes a pallet stacking station for storing the unloaded pallet, the pallet stacking station located over a shuttle aisle that extends under the EES. A pallet shuttle that traverses the shuttle aisle to a first position under the EES for handling the unloaded pallet in the EES, and to a second position under the pallet stacking station for stacking the unloaded pallet. The garage also includes a transport system for transporting the loaded pallet in the storage area.

The garage also includes a mechanism for delivering and storing pallets. According to another aspect of the present invention directed toward storage of pallets, a pallet shuttle is positioned in a first position under an entry/exit station. The entry/exit station is an area for receiving and discharging a vehicle. It includes a pallet and a first retractable pallet support mechanism supporting the pallet. The method also includes the step of elevating a support platform of the pallet shuttle to support the pallet. The method further includes the steps of retracting the first retractable pallet support mechanism, lowering the support platform and pallet, and moving the pallet shuttle from the first position to a second position under a pallet stacking station for storing a pallet. The support platform is then elevated thereby lifting the pallet into the pallet stacking station. A second retractable pallet support mechanism operative to support the pallet is then engaged, and the support platform is lowered, thereby causing the second retractable support mechanism to support the lowest pallet in the pallet stacking station.

Still another aspect of the present invention is directed toward delivery of a pallet to an entry/exit station of the automated parking garage, the pallet shuttle is positioned in a second position under the pallet stacking station. The pallet stacking station includes a pallet stack having a lowermost pallet. The pallet stacking station also includes a second retractable pallet support mechanism supporting the lowest pallet of the pallet stack. The support platform of the pallet shuttle is then elevated, thereby lifting the pallet stack within the pallet stacking station, retracting the second retractable pallet support mechanism, and lowering the support platform, thereby causing the lowermost pallet of the pallet stack to pass through the second retractable support mechanism of the pallet stacking station. The second retractable support mechanism is then engaged, thereby supporting all of the pallets of the pallet stack except the lowermost pallet. The pallet shuttle and the lowermost pallet are then moved from the second position to the first position under the entry/exit station for receiving and discharging a vehicle. The entry/exit station includes the first retractable pallet support mechanism operative to support a pallet. The support platform and the pallet are then elevated, thereby positioning the pallet in the entry/exit station, and the first pallet support mechanism is engaged, thereby supporting the pallet.

It is a further aspect of the present invention to increase the efficiency of an automated parking garage by significantly increasing the throughput of an automated parking garage, and improving the performance of the automated parking garage by, for the most part, handling empty pallets separately from the mechanics employed to store and retrieve vehicles on the all floors of the garage.

For a better understanding of the present invention, reference should be made to the accompanying drawings and descriptive matter in which there is illustrated a preferred embodiment of the invention. The foregoing has outlined some of the more pertinent aspects thereof. These aspects should be construed to be merely illustrative of some of the more prominent features and applications of the present invention. Many other beneficial results can be attained by applying the disclosed invention in a different manner or by modifying the invention within the scope of the disclosure. Accordingly, other aspects and a fuller understanding of the invention may be obtained by referring to the summary of the invention and the detailed description of the preferred embodiment in addition to the scope of the invention illustrated by the accompanying drawings.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE INVENTION

Figure 1:
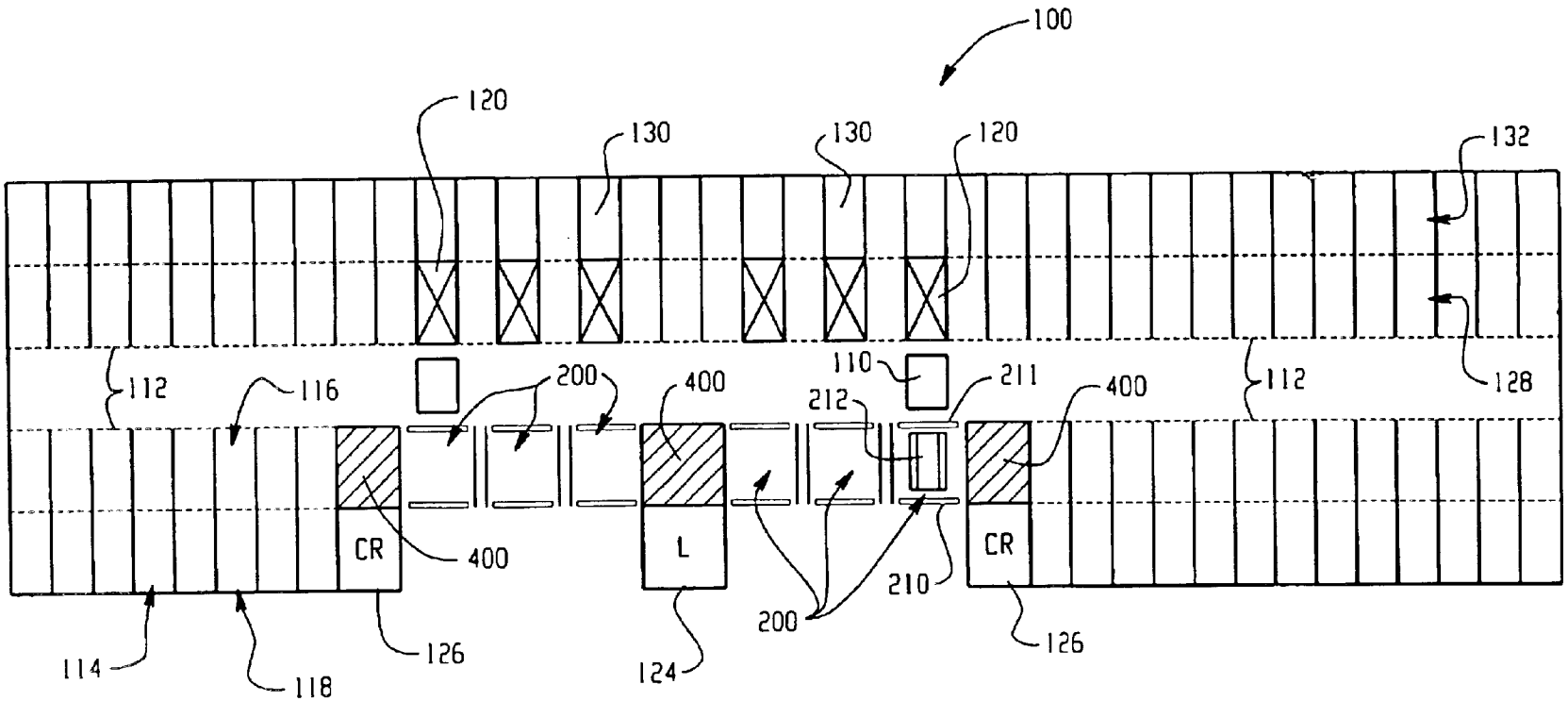
FIG. 1 is a plan view of an automated parking garage employing the present invention.

Referring now to the drawings, FIG. 1 illustrates an automated parking garage 100 that incorporates the method and apparatus for distributing and storing pallets according to the present invention. As shown, automated parking garage 100 includes six entry/exit stations (EES) 200. Each EES 200 is for receiving and releasing vehicles stored in the automated parking garage 100. In this particular embodiment, there are provided three pallet stacking stations (PSS) 400 that are located near the several EES 200. Of course, more or fewer EES 200 and PSS 400 may be employed depending on the actual and projected throughput of the garage 100. The one or more PSS 400 are for storing empty pallets 212, which pallets are used for supporting vehicles during vehicle storage and retrieval operations. The pallet 212 is removed from the PSS 400 and distributed to the EES 200 as necessary to accommodate incoming vehicles. The pallet 212 is removed from the EES 200 and stored in the PSS 400 as necessary to accommodate outgoing vehicles. Pallets 212 are transported between the plurality of EES 200 and PSS 400 using one or more pallet shuttles (not shown, but described more fully hereinbelow).

The automated parking garage 100 includes a number levels (or floors) each including a plurality of vehicle storage slots 114 for storing vehicles. As shown, each storage slot 114 comprises an interior storage rack 116 and an exterior storage rack 118 such that the storage slot 114 may store up to two vehicles. Thus a first vehicle may be stored in the interior storage rack 116 and a second vehicle may be stored in the exterior storage rack 118. In addition to the storage available for vehicles shown in FIG. 1, storage for vehicles is provided on upper and/or lower floors of the automated parking garage 100. One or more vertical lift conveyors (VLC) 120 are provided for transporting vehicles between floors of the automated parking garage 100. Note that the disclosed automated parking garage architecture is sufficiently flexible to accommodate varying rows of parking, for example, two rows, three rows, fours rows, etc.

During storage and retrieval operations, a vehicle is transported on a supporting pallet 212 between the storage slot 114 and one of the EES 200 using a carrier module 110. The carrier module 110 accomplishes such transportation via an aisle 112. The carrier module 110 includes a rack entry module (REM) (described in more detail hereinbelow) for transferring the pallet 212 (in an empty or unloaded state, or carrying a vehicle in a loaded state) between the carrier module 110 and, the interior and exterior storage racks (116 and 118), an EES 200, or a VLC 120.

The facilities of the automated parking garage 100, including the VLC 120, the carrier module 110, REM, pallet shuttle 250, and pallet vertical lift (PVL) 610 (shown in greater detail hereinbelow) are controlled by a central garage computer control system. The central computer control system, executing the appropriate system control software, is preferably housed in one or more control rooms 126. The automated parking garage 100 further includes one or more lobbies 124 where a customer may request a vehicle to be retrieved, and pay for the automated parking service.

When a vehicle enters the automated parking garage 100, the vehicle enters one of the EES 200 through an open exterior door 210 and moves onto the pallet 212, both of which are described in greater detail hereinbelow. Before the vehicle enters one of the EES 200, an interior door 211 is closed to prevent the vehicle occupants from accessing the interior of the automated parking garage 100. The driver and passengers of the vehicle exit the vehicle and EES 200, and activate the automated parking process via an automated parking teller located just outside of the exterior door 210 of the EES 200, thereby closing the exterior door 210 of the EES 200. In response thereto, the carrier module 110 moves along the aisle 112 to a position corresponding to the EES 200 through which the vehicle entered the garage 100. The REM of the carrier module 110 is controlled to remove the loaded pallet 212 from the EES 200 and retrieve it onto the carrier module 110. The carrier module 110 includes a turntable mechanism (described in greater detail hereinbelow) that then turns 180 degrees so that the vehicle can be retrieved to the EES 200 wherein the customer can drive out of the EES 200, instead of having to back out. In an alternative garage embodiment, where one or more EES 200 are constructed on either side of the aisle 112, the turntable feature may not be necessary since the vehicles can now enter an EES 200 on one side of the aisle 112, and exit via an different EES on the other side. The central computer determines the availability of a select one of the plurality empty storage racks (116 or 118) in which to store the vehicle with supporting pallet 212. The central computer then directs the carrier module 110 to traverse the aisle 112 to a position corresponding to the predetermined empty storage rack (116 or 118) of the storage slot 114.

In the event that the predetermined storage rack (116 or 118) is located on a different floor of the garage 100, the carrier module 110 is positioned across from one of the VLC 120, and the REM is controlled to transfer the pallet 212 with vehicle to the VLC 120. The VLC 120 transports the pallet 212 with vehicle to the appropriate floor of the automated parking garage 100 where both the pallet 212 and vehicle are transferred to another carrier module 110 on that floor. Once the other carrier module 110 carrying the pallet 212 with vehicle is in a position corresponding to the predetermined storage rack, e.g., exterior storage rack 118 on the floor, the REM is controlled to transfer the pallet 212 with vehicle to the predetermined storage rack 118 for storage. One of ordinary skill in the art will understand that similar steps may be executed when retrieving the vehicle from the storage rack 118 on either the upper/lower or entrance floors.

According to the present invention, the pallets 212 that are not in use (i.e., supporting a stored vehicle) are stored in the PSS 400 by a pallet storage and distribution system. In other words, the pallets 212 are distributed from the PSS 400 to a nearby EES 200 only as necessary to accommodate incoming vehicles. Similarly, when an outgoing vehicle vacates its pallet 212, the unloaded pallet 212 may be transferred to the PSS 400 for storage. The pallets 212 stored in PSS 400 provide an immediate inventory of empty pallets for operating the automated parking garage 100. Additional pallets 212 may be stacked (or accumulated) into pallet bundles in a pallet stack support mechanism (described in greater detail hereinbelow) and stored for future use in an otherwise empty parking rack (e.g., interior rack 116) on upper/lower floors. Such additional pallets 212 may be stored and retrieved using either dedicated hardware, or the same hardware used for storing and retrieving vehicles on the upper/lower floors. If dedicated hardware is not used, requests for storing and retrieving pallet stacks to/from storage racks are preferably processed during a lull in the operation of the automated parking garage 100 (such as at 3:00 AM) in order to efficiently utilize the resources of the automated parking garage 100.

Note that there is a number of VLCs 120 constructed into the garage 100 (six in this embodiment) to provide vertical access between the floors, and that the VLCs 120 are constructed on an interior row 128. Thus there are corresponding VLC storage racks 130 "behind" the VLCs 120 in an exterior row 132 that can be utilized for storing a vehicle. In order to do so, the VCL 120 must be elevated to the level of the VLC storage rack 130 so that the carrier module 110 supporting a loaded pallet 212 can insert the loaded pallet across (or through) the VLC 120 to the VLC storage rack 130. Of course, for retrieving the vehicle, the VCL 120 must be in position at the level of the VLC storage rack 130 from which the vehicle is to be retrieved in order for the carrier module 110 to gain access to the loaded pallet 212 stored in the VLC storage rack 130.

Since the garage 100 is a multi-level building having a plurality of vehicle storage racks, each level has an aisle 112 with associated rail system and one or more carrier modules 110 for traversing the length of the garage 100 at that level. The carrier modules 110 of any particular floor operate independently in accordance with instructions from the garage control system. There is also overlapping range of the carrier modules 110 of any given floor as they traverse the aisle of that floor such that at least two carrier modules 110 can access the same storage slot 114 and the same VLC 120. Of course, the carrier modules 110 of the entrance level also have overlapping range such that any EES 200 can be accessed by at least two of the carrier modules 110 of the entrance level.

Figure 2:
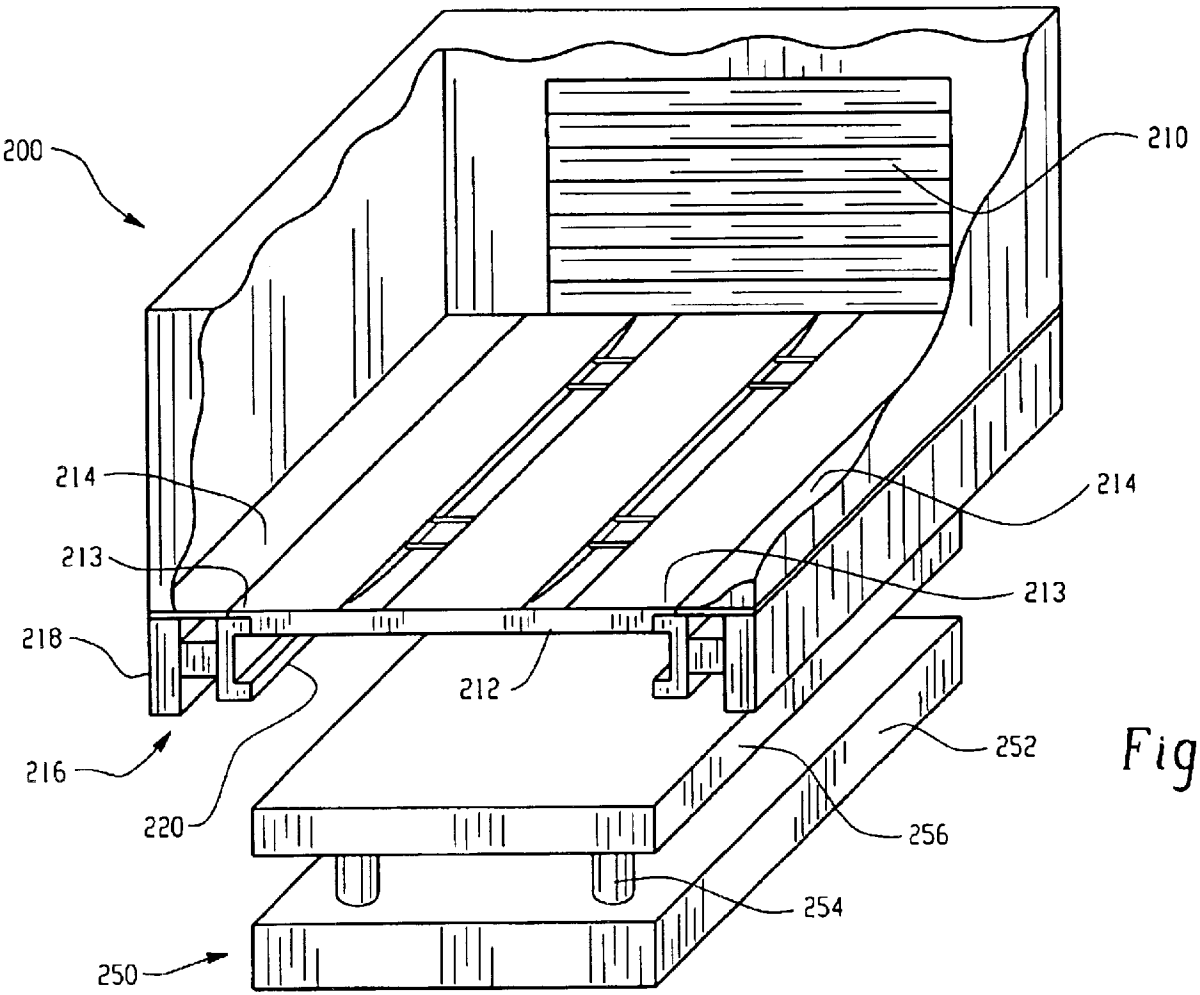
FIG. 2 is an isometric view of an entry/exit station (EES) of the automated parking garage of FIG. 1.

Referring now to FIG. 2, there is illustrated an isometric representation of one of the ESS 200. The EES 200 is a bay located on an entrance floor of the automated parking garage 100 at grade level or other levels where vehicles enter or exit the garage 100, and having dimensions similar to a residential single-car garage. Typically, the EES 200 will have a width of between approximately fourteen and sixteen feet, and a length of between approximately twenty and twenty-two feet.

As indicated above, the EES 200 includes the interior door 211 (not shown) for providing access between the EES 200 and the interior of the automated parking garage 100. The EES 200 further includes the exterior door 210 through which an incoming vehicle may enter or an outgoing vehicle may exit, the automated parking garage 100. When entering the garage 100, the incoming vehicle is positioned on the pallet 212, which pallet 212 forms a central portion of the floor of EES 200. The incoming vehicle may be positioned on the pallet 212 using any number of mechanisms, such as grooves, bumpers, lights (e.g., marquees) and acoustic signals. A passenger walkway 214 is provided on either side of the pallet 212 to enable the driver and other passengers of a vehicle to exit the vehicle and EES 200 of the automated parking garage 100 prior to initiation of the vehicle storage process.

The pallet 212 is supported by two retractable pallet supports 216. Each retractable pallet support 216 includes a track 220 and a track retractor 218. The pallet 212 has a pallet lip 213 running the length of each side. A portion of the pallet lip 213 for each side of the pallet 212 lies on top of the respective track 220. The pallet 212 is installed into and removed from the EES 200 using a pallet shuttle 250. The pallet shuttle 250 is disposed underneath the EES 200 in a separate runway extending parallel to the aisle 112. The pallet shuttle 250 includes a pallet shuttle base 252 having motive means for moving the pallet shuttle 250 between a first position underneath the EES 200, and a second position underneath the PSS 400 (not shown). The motive means for moving the pallet shuttle 250 may include wheels, a track, and/or any other well-known movement mechanisms. The pallet shuttle 250 further includes a pallet shuttle support platform 256 for carrying the empty pallet 212, and a pallet shuttle elevation mechanism 254 for raising and lowering the pallet shuttle support platform 256 (and any pallet 212 supported thereupon).

When the pallet 212 is distributed to one of the EES 200, the pallet shuttle 250 carrying the pallet 212 is positioned under the appropriate EES 200. The retractable pallet support mechanism 216 is then controlled to cause the track retractors 218 to drive the tracks 220 to a retracted position, thereby allowing the pallet shuttle 250 to elevate the pallet 212 into the proper position for installation into the EES 200. To complete the installation of the pallet 212 into the EES 200, each retractable pallet support mechanism 216 causes the corresponding track retractors 218 to extend, driving the tracks 220 into a support position. Once the tracks 220 are in a support position, the pallet shuttle support platform 256 is lowered, causing the pallet 212 to rest onto the tracks 220, and installation of the pallet 212 is complete, leaving the pallet shuttle 250 free to be used for other tasks. One of ordinary skill in the art will recognize that similar steps may be executed to remove the pallet 212 from the EES 200 for storing in the PSS 400.

Reference is now to FIGS. 3A–9 that illustrate the structure and operation of the present invention, including the steps performed for storing the pallet 212 that has been vacated by an outgoing vehicle. Of course, the same structural elements can be used to perform steps for distributing the pallet 212 to the EES 220 for an incoming vehicle.

Figure 3A:
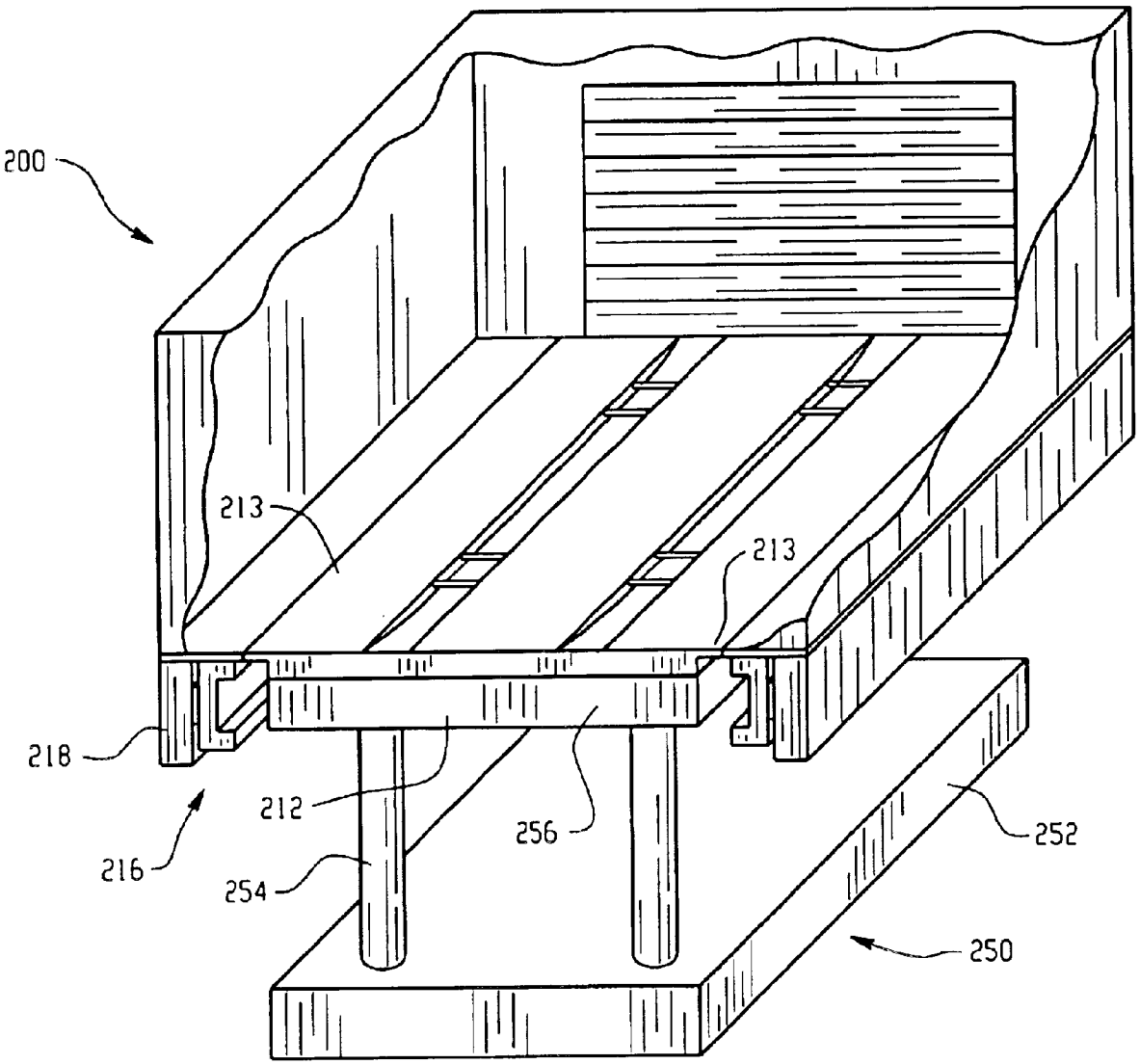
FIGS. 3A and 3B illustrate isometric views of the EES of FIG. 2 during the removal of an empty pallet.

FIG. 3A illustrates an isometric representation of the EES 200, and the structure of the present invention for executing the first steps required for removal of the pallet 212 from the EES 200. As shown, the pallet shuttle 250 causes the pallet shuttle elevation mechanism 254 to raise the pallet shuttle platform 256 into a position supporting the pallet 212. Each retractable pallet support mechanism 216 then causes the corresponding track retractor(s) 218 to position the tracks 220 in a retracted position, which clears the pallet lip 213 on each of the sides of the pallet 212. The pallet 212 and pallet shuttle support platform 256 are then lowered by the pallet shuttle elevation mechanism 254 by passing through the aperture defined, in part, by the tracks 220.

Figure 3B:
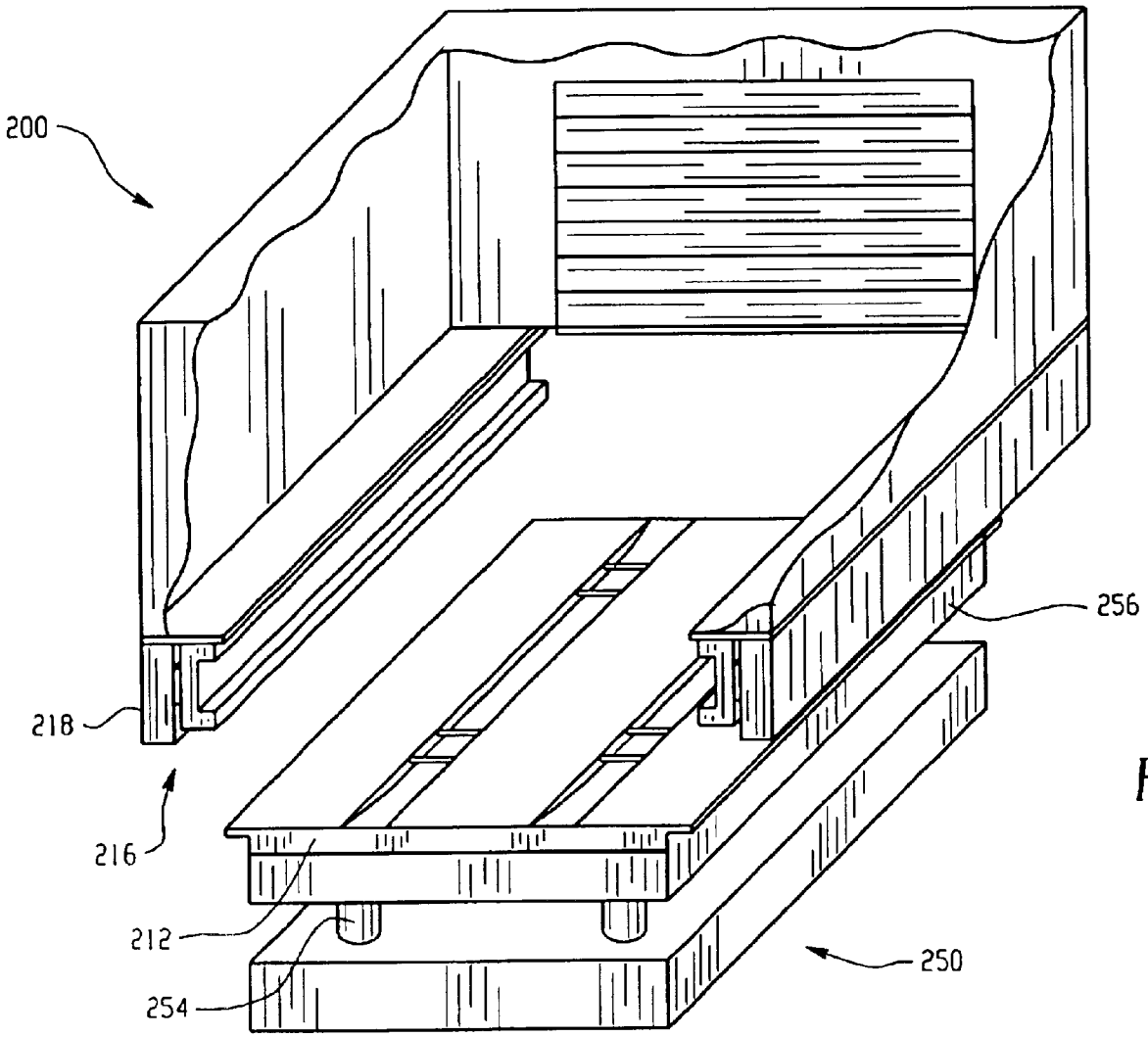

FIG. 3B shows the status of the pallet shuttle 250 just after the pallet 212 has been removed from the EES 200. The pallet shuttle 250 is illustrated with the pallet shuttle elevation mechanism 254 in a partially lowered state. Once the pallet shuttle elevation mechanism 254 sufficiently lowers the pallet shuttle support platform 256 and pallet 212, the pallet shuttle 250 transports the pallet 212 to another part of the parking garage 100 for storage.

Figure 4:
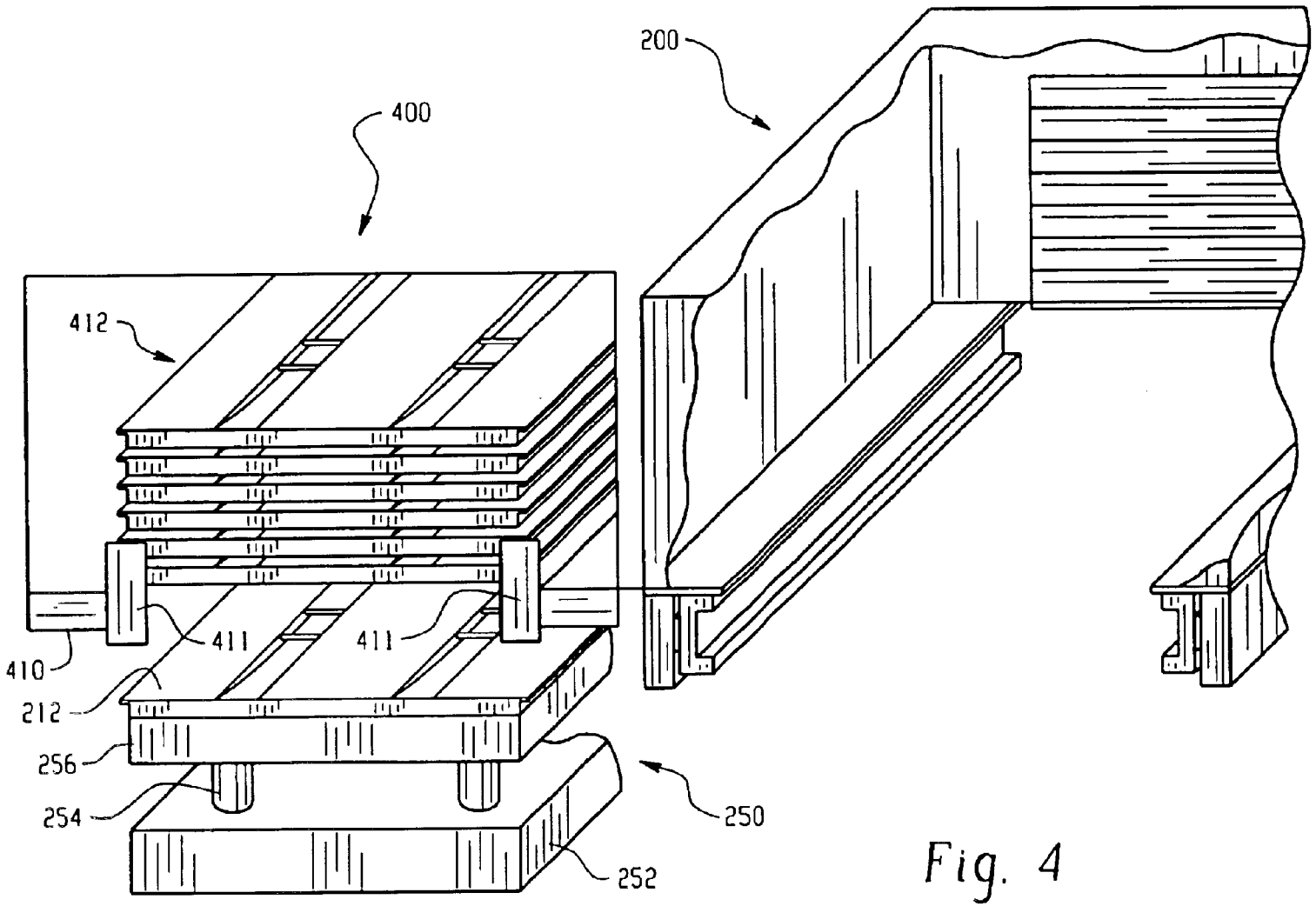
FIG. 4 is an isometric view of the EES of FIG. 2 and an adjacent pallet stacking station (PSS)

Referring now to FIG. 4, there is illustrated a broader view isometric representation of the EES 200 showing the PSS 400 adjacent to the EES 200. The PSS 400 includes a pallet stack support mechanism 410 with pallet latches 411 that provide support for a stack of pallets 412 that are suspended over the pallet shuttle 250. The PSS 400 is used to store the pallets 212 that may be immediately delivered to EES 200. The PSS 400 further serves to store the empty pallets 212 recently removed from the EES 200.

Once the pallet 212 has been removed from the EES 200, as illustrated hereinabove in FIG. 3A and FIG. 3B, the pallet shuttle base 252 of the pallet shuttle 250 traverses on a shuttle rail system carrying the empty pallet 212 and moves into an alignment position under the PSS 400. The PSS 400 and the pallet stack 412 are then lowered to a position where the empty pallet 212, as supported by the pallet shuttle support platform 256, is lifted by the pallet shuttle elevation mechanism 254 into the PSS 400 from below, and ultimately placed at the bottom of pallet stack 412. The pallet stack support mechanism 410 is configured to permit the pallet 212 to enter the PSS 400 from underneath, and to provide support for the pallet 212 and the remaining pallets in pallet stack 412 once all of the pallets are rested on pallet support mechanism 410.

Figure 5:
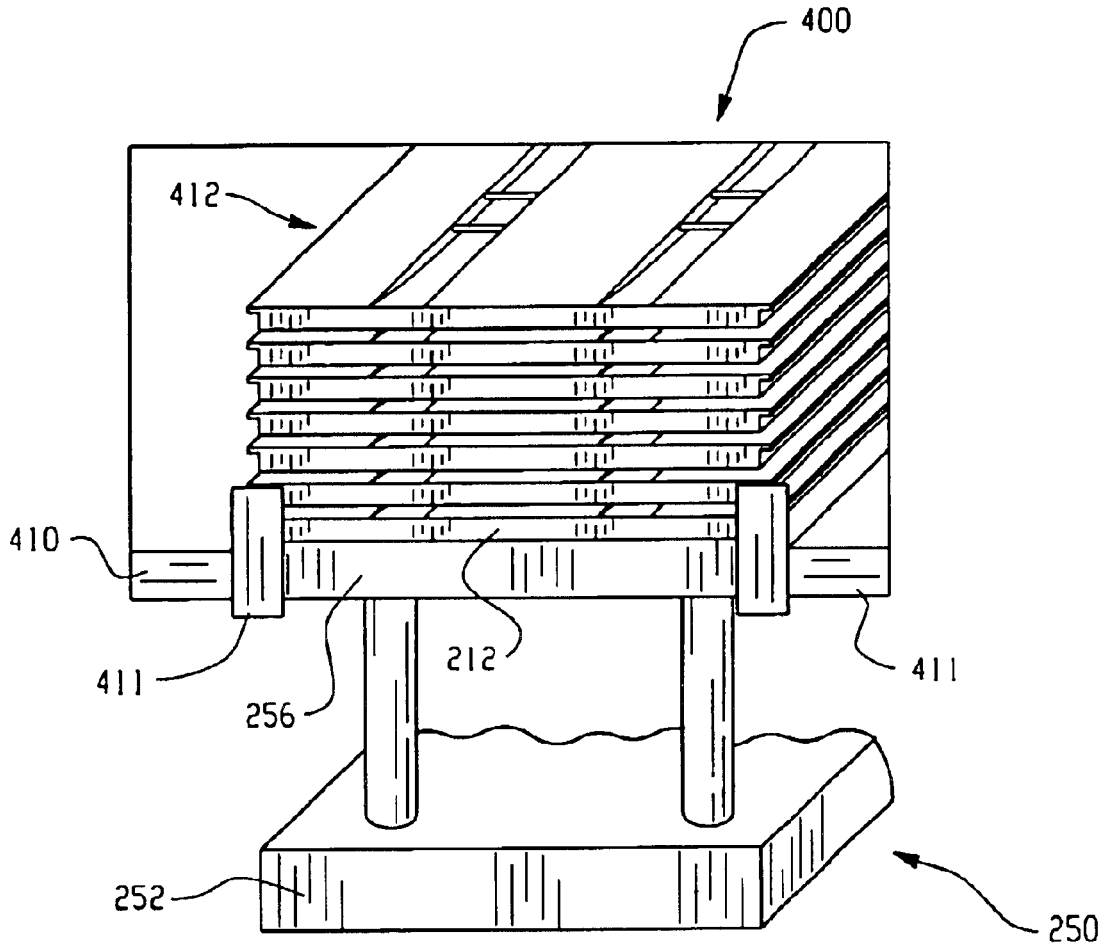
FIG. 5 is an isometric view of the PSS of FIG. 4 receiving a pallet for storage.

Referring now to FIG. 5, there is illustrated the insertion of the pallet 212 into the PSS 400. The pallet shuttle 250 is illustrated with the pallet shuttle support platform 256 elevated such that the pallet 212 is lifted under the pallet stack 412 until the pallet stack support mechanism 410 with the pallet latches 411 catch the pallet 212 from underneath and provide vertical support for pallet stack 412, once the pallet shuttle support platform 256 is lowered. The PSS 400 is designed to accommodate a pallet stack 412 of up to ten pallets. As necessary, the pallet stack 412 may be removed from PSS 400 by a pallet vertical lift (PVL) to an upper/lower floor for medium or long-term storage.

Figure 6:
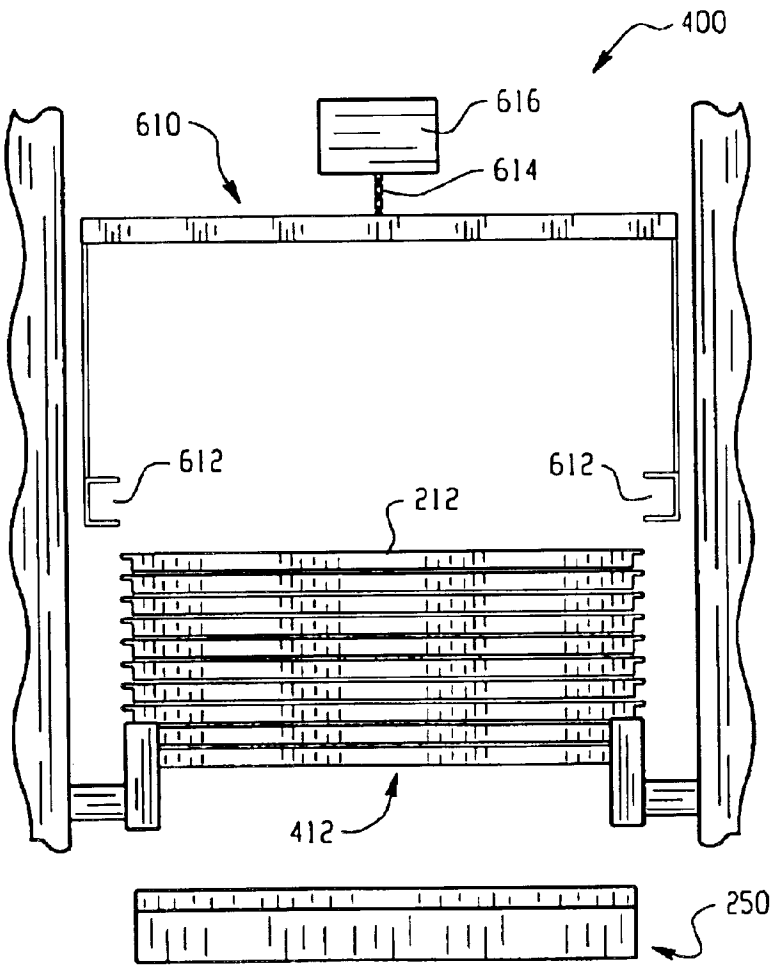
FIG. 6 is an isometric view of the PSS of FIG. 5 and a pallet vertical lift (PVL) in an open position.

FIGS. 6 through 10 illustrate the structure and steps performed to remove the pallet stack 412 for medium or long-term storage. Referring now to FIG. 6, there is illustrated a representation of the PSS 400. As shown, the PSS 400 is filled to capacity with the pallet stack 412 having ten pallets 212. As further shown in FIG. 6, a PVL 610 is positioned directly above the PSS 400 for lifting the pallet stack 412. The PVL 610 includes a pair of tongs 612 for supporting the weight of pallet stack 412 during lifting. The PVL 610 further includes a PVL support 614 and PVL motive means 616 for raising and lowering the tongs 612.

Figure 7:
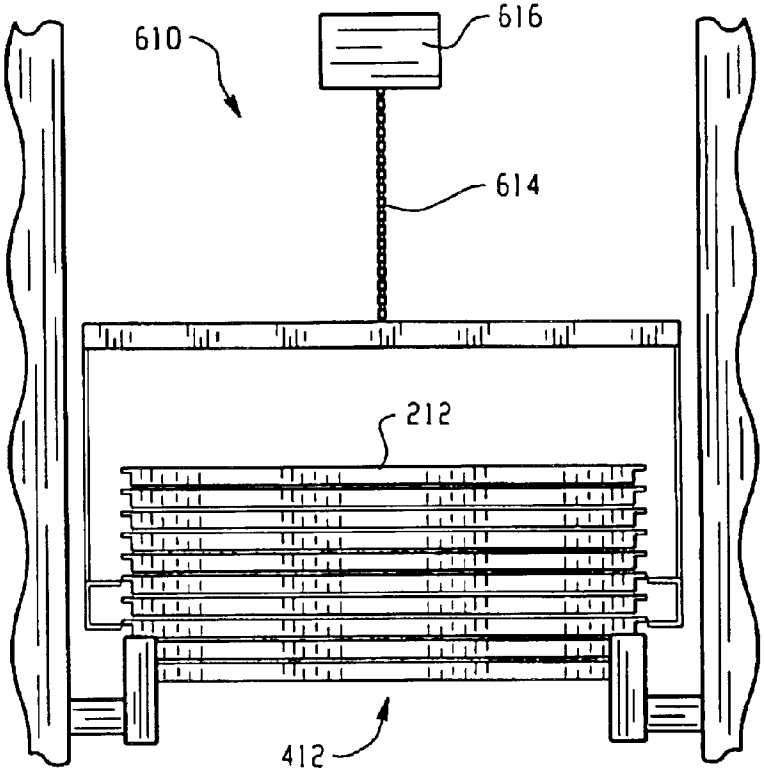
FIG. 7 is an isometric view of the PVL of FIG. 6 partially descended in an open position.

Referring now to FIG. 7, there is illustrated the PSS 400 of FIG. 4, and the PVL 610 partially descended with the tongs 612 in an open stance during the removal process of a pallet stack 412. The PVL 610 operates to lower the tongs 612 along the sides of pallets 212 of the pallet stack 412, and after the tongs 612 pass the bottom pallet of the pallet stack 412, the PVL 610 closes the tongs 612 and then lifts the pallet bundle 412. The pallet stacker ten disengages, to an upper/lower floor for medium or long term storage.

When bringing a pallet bundle 412 to the PSS 400, the PVL 610 is fed a pallet bundle 412 from equipment of the upper or lower floor. The PVL 610 then lowers the pallet bundle 412 into the pallet stack support mechanism 410, where the pallet latches 411 engage the lowest pallet of the pallet bundle 412. The PVL 610 then further lowers a short distance (e.g., 1–2 inches), and disengages the tongs 612 to an open stance. Once the PVL 610 elevates above the pallet bundle 412, the PVL 610 then closes the tongs 612 and rises to a upper floor position. The steps are reversed, as indicated in the description hereinbelow, when removing a bundle from the PSS 400 to a storage location.

Figure 8:
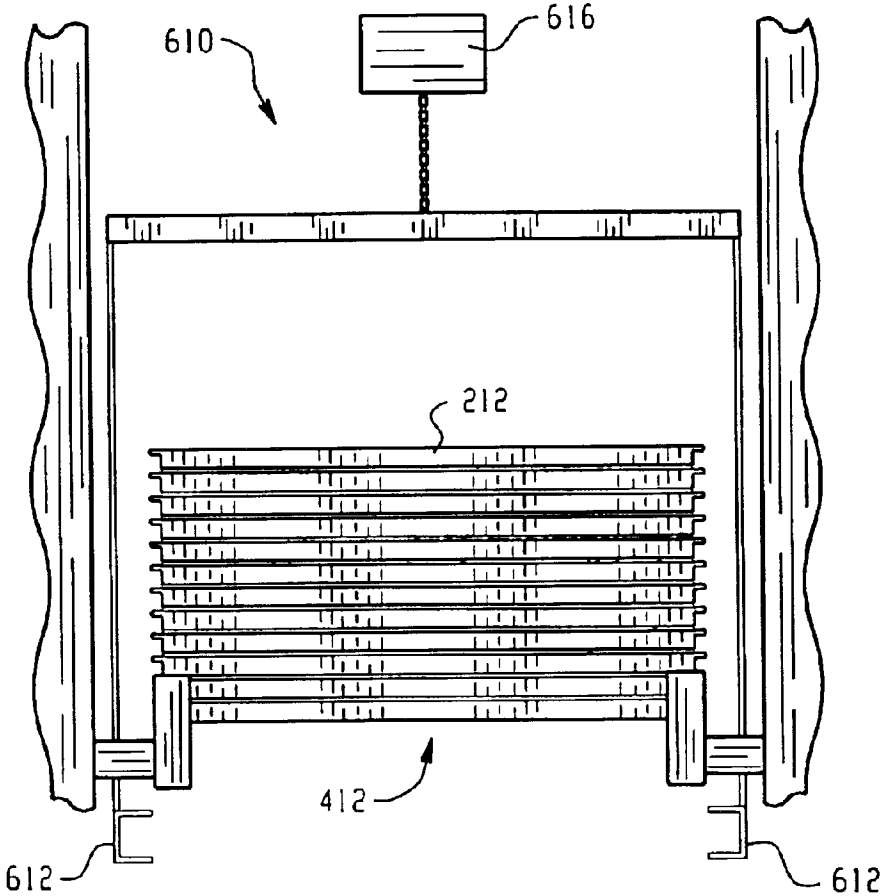
FIG. 8 is an isometric view of the PVL of FIG. 6 fully descended in an open position.

Referring now to FIG. 8, there is illustrated a view of the PVL 610 fully descended with the tongs 612 in an open stance.

Figure 9:
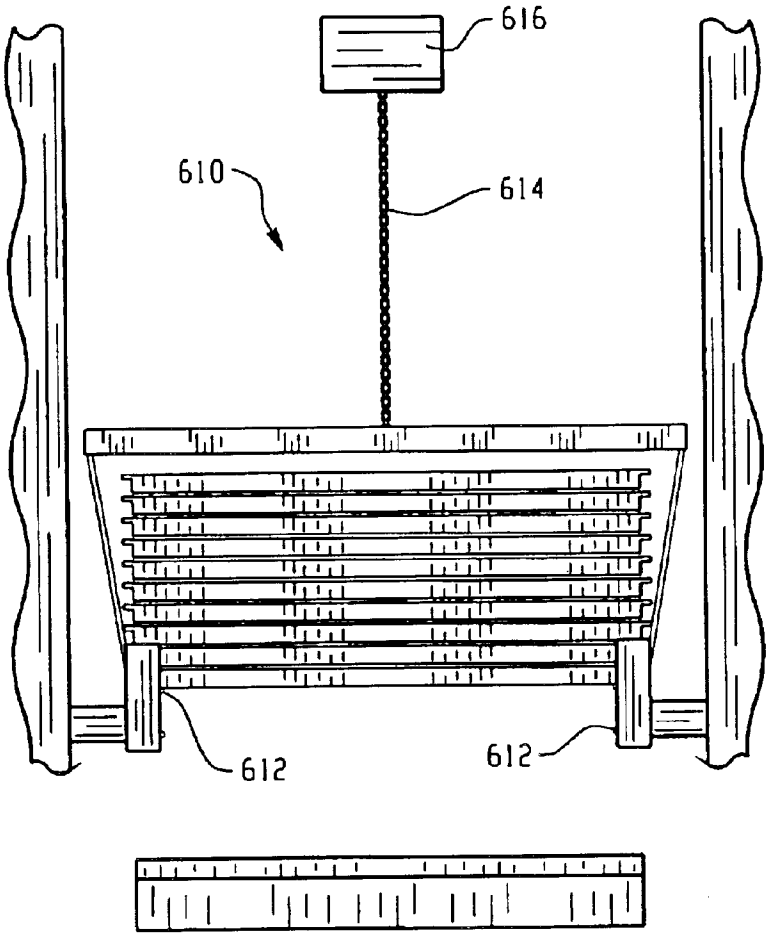
FIG. 9 is an isometric view of the PVL of FIG. 6 fully descended in a closed position.

Referring now to FIG. 9, there is illustrated the PVL 610 in a fully descended position with the tongs 612 in a closed position. The tongs 612 are illustrated in a closed position in preparation for the PVL 610 rising, and thereby supporting the weight of pallet stack 412. The pallet stack 412 is then lifted vertically and removed from PSS 400 for longer-term storage in another portion of automated parking garage 100. Once the PVL 610 is in an upper or lower floor position, secondary parking machinery may be used to retract the pallet stack 412 from the PVL 610. Such secondary parking machinery may then store the pallet stack 412 in an empty vehicle storage rack (e.g. storage rack 116). Of course, a similar process may be employed to retrieve the stored pallet stack 412 and supply it to the PVL 610.

The PVL 610 lifts the pallet bundle 412 either up or down depending if utilized in an underground garage or an above ground garage; in either case the PVL 610 moves the pallet bundle 412 to a floor other than the entrance floor (i.e., floor with the EES 220).

Figure 10:
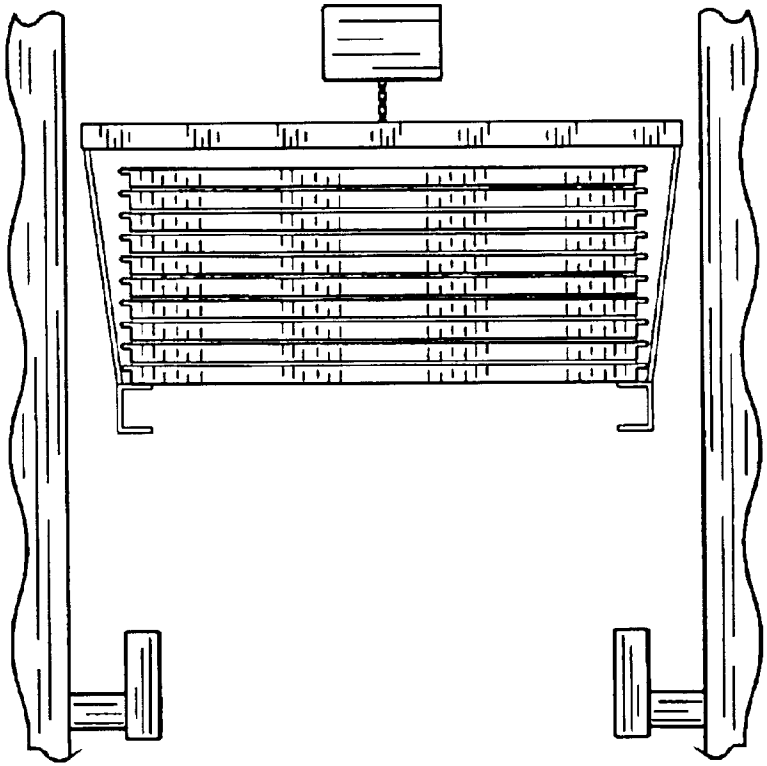
FIG. 10 is an isometric view of the PVL of FIG. 6 fully ascended in a closed position.

Referring now to FIG. 10, there is illustrated the tongs 612 in a closed stance and the PVL 610 in a fully ascended position while supporting pallet stack 412.

Figure 11A:
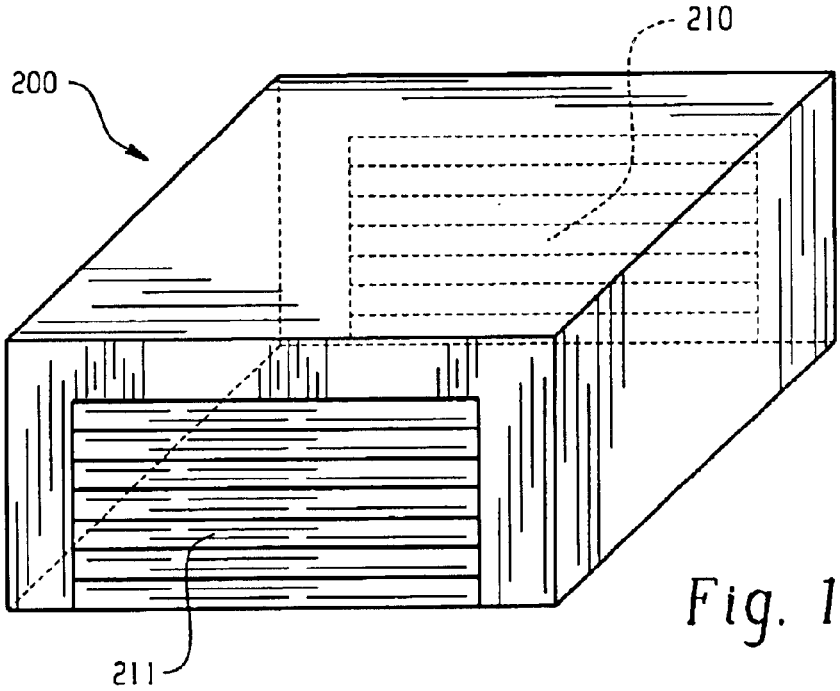
FIG. 11*a* is an isometric view of the exterior and interior door of the EES of FIG. 2.

Referring now to FIG. 11*a*, there is illustrated a general diagram of the EES 200, and the locations of the exterior door 210 and interior door 211 thereof.

Figure 11B:
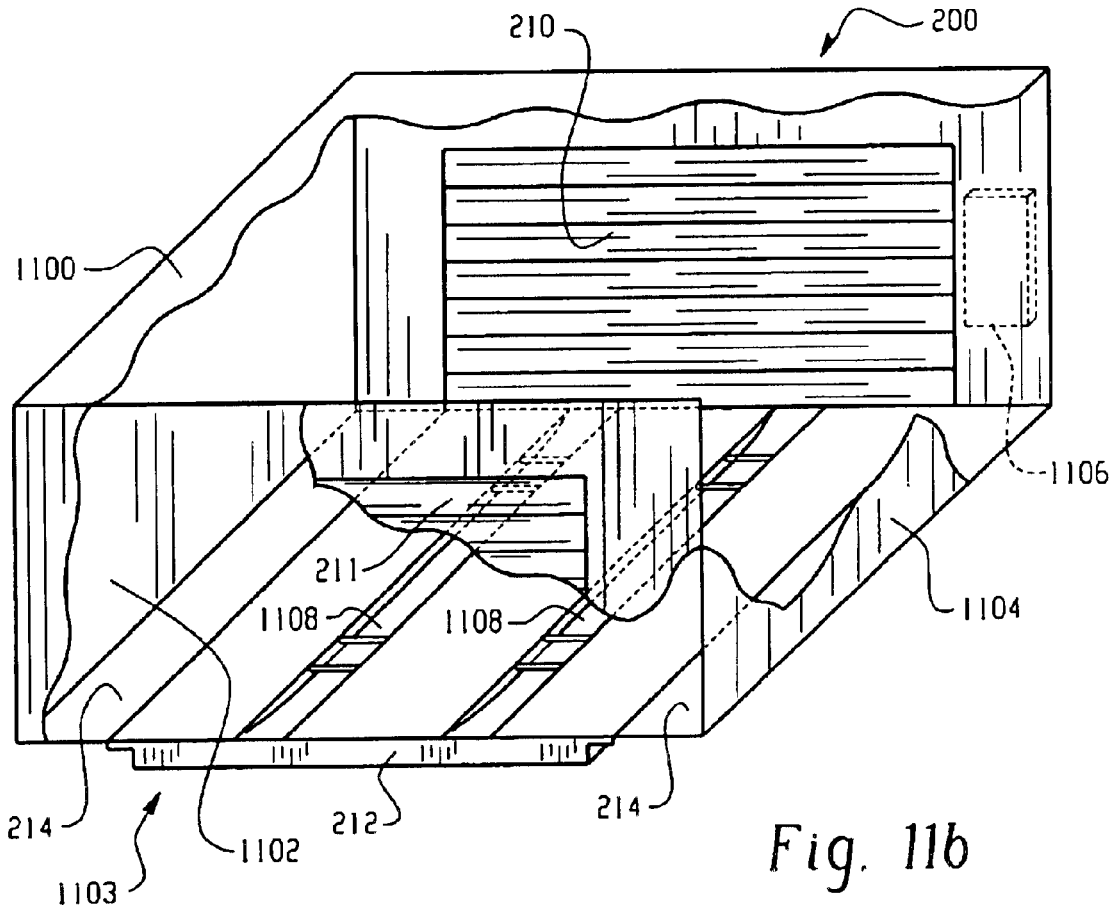
FIG. 11*b* is a more detailed isometric view of the EES of FIG. 2.

Referring now to FIG. 11*b*, there is illustrated a more detailed view of the EES 200. As indicated hereinabove, the EES 200 facilitates entry and exit of a vehicle of the parking garage 100. The EES 200 is similar in size to a conventional residential single-car garage. The EES 200 includes the exterior door 210 that provides access by a vehicle to the exterior of the garage 100 once retrieved, and entry to the garage 100 for parking, and the interior door 211 (in a cutaway portion) that provides access to the interior of the garage 100. The exterior and interior doors (210 and 211) can be roll-up doors such that the "up" position puts either door on a rail in the ceiling area of the EES 200. In normal operation, only one door is open at any point in time.

The EES 200 has a ceiling 1100 that is closed off to preclude exposure to mechanisms that may be constructed overhead. Similarly, the EES 200 includes a first sidewall 1102 and a second sidewall 1104, both of which are constructed for safety purposes to prevent exposure to the mechanisms interior to the garage 100. The floor area 1103 of the EES 200 includes the pallet 212 and the walkways 214 on either side of the pallet 212 so that the customer can exit or enter the vehicle from the walkways 214. The top of the pallet 212 is positioned substantially at floor level with the walkways 214 to presenting potential trip hazards to customers. As illustrated, the pallet 212 includes a pair of tire guides 1108 into which the vehicle tires should enter when the vehicle is driven onto the pallet 212. This helps the customer determine where to park the vehicle on the pallet 212.

In this particular embodiment, an automated parking teller 1106 is provided exterior to the EES 200 that the customer accesses to purchase the parking service, and to initiate the parking process. Once the transaction is completed, the customer makes a selection that initiates the parking process, causing the exterior door 210 to close. Note that in an alternative embodiment, the automated parking teller 1106 can be located inside of the EES 200 such that once the parking transaction is completed at the teller 1106, the customer (and any passengers) must exit the EES 200 prior to the parking process initiating. In either case, the interior of the EES 200 can include one or more motion sensors that prevent initiation of the automated parking garage mechanisms by the garage control system when motion is detected by the presence of the customer and/or passengers in the interior of the EES 200. Thus when the customer has paid for the parking service, and the customer and all passengers have vacated the EES 200, the motion sensors indicate as such, and the control system of the garage 100 then enables the parking procedure for that vehicle.

At the EES 200, the transaction includes either giving a ticket, reading an RF (radio frequency) tag (e.g., an EZ pass or similar), or reading a credit card. It is appreciated that other conventional transaction methods can also be provided with suitable accommodations for processing such transactions. Once the customer returns and wants his car back, he/she simply goes to the lobby 124 where a ticket reader, credit card reader, or RF reader is utilized to process the corresponding method for clearing payment, thereby initiating retrieval of the vehicle. A message center in the lobby 124 will tell the customer where to pick up the vehicle (i.e., which of the EES 200 or terminals).

As indicated hereinabove, more robust implementations of the automated parking teller 1106 can accommodate payment methods that include cash, debit cards, rechargeable pre-purchased parking debit cards, or many other conventional means for completing the transaction. Additionally, the automated teller 1106, and other automated tellers associated with the other EES 200 of the garage 100 are networked to one or more computer systems that facilitate the use of the aforementioned payment methods. For example, where a credit card is utilized, the teller 1106 must interface to a network that provides access to the credit database of the card user so that payment can be properly authorized. Such access can be provided via a packet-switched network such as the Internet, by the circuit-switched network of the Public Switched Telephone Network, or GPS (global positioning system).

Additionally, the garage 100 can be suitably constructed to provide services other than simply parking the car. For example, the customer could, at the time of accessing the automated teller 1106, select that his or her vehicle be washed during the time in which the vehicle is parked at the garage 100. Thus at some time, a garage attendant would be made aware of the purchased service, retrieve the vehicle, wash it, and return the vehicle to its parking rack in the garage 100. Other services can also be provided as desired by the garage owner, in a more robust implementation of the garage 100 such as performing routine engine maintenance to include changing oil, performing a tune-up, car detailing, etc.

Note that the disclosed automated garage 100 can be implemented to accommodate storage for items other than vehicles. For example, the pallet 212 can be adapted to accommodate compatible storage containers such that the containers can be delivered, stored, and retrieved utilizing the existing garage equipment and systems. Additionally, such storage containers can be constructed for use within the garage 100 without using the pallet 212.

Figure 12:
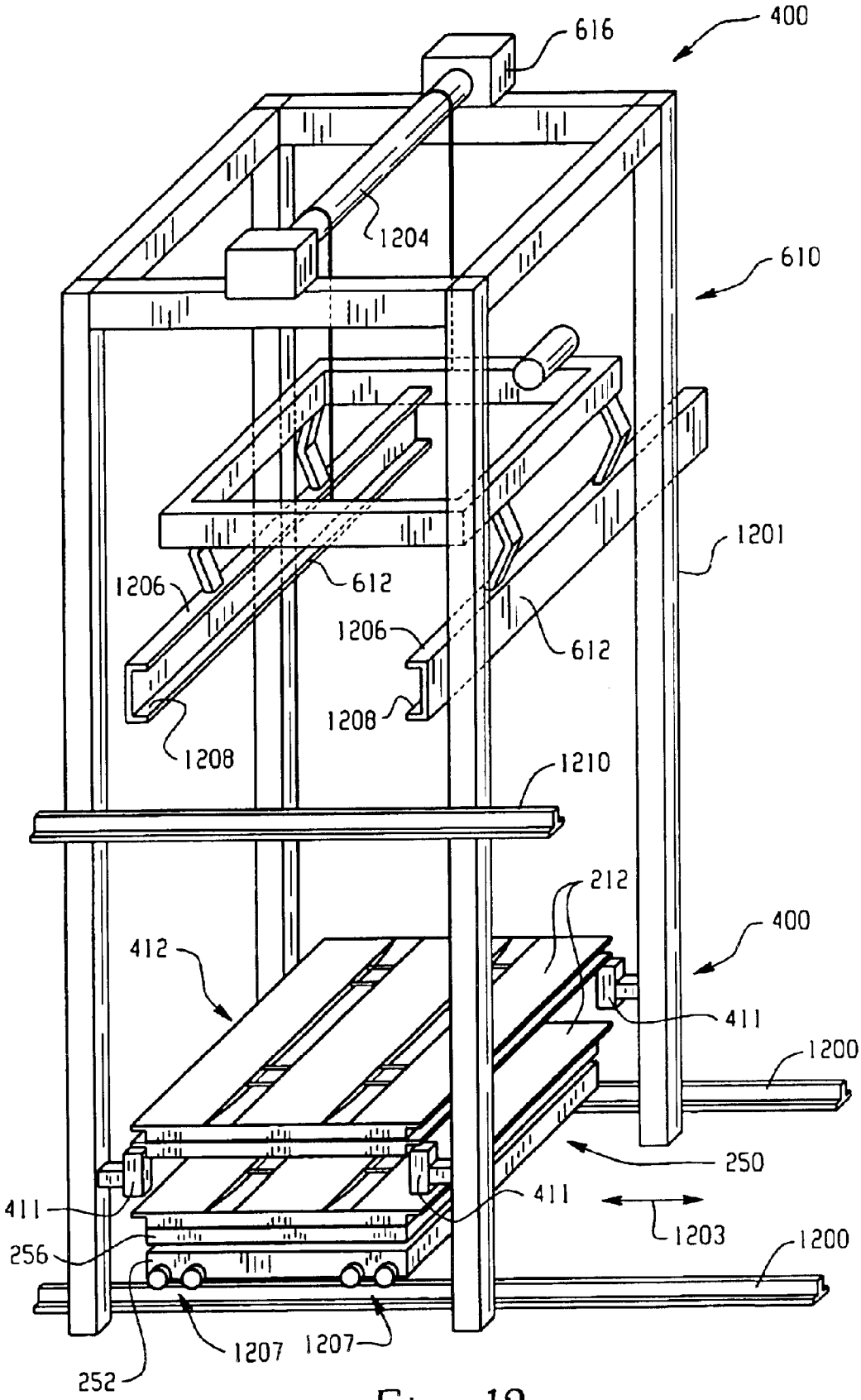
FIG. 12 illustrates a more detailed view of the PSS assembly that includes the pallet stack support mechanism and PVL.

Referring now to FIG. 12, there is illustrated a more detailed isometric of the PSS assembly 400 that includes the pallet stack support mechanism 410 and PVL 610. In this particular embodiment, the PSS 400 is constructed into a multi-floor steel beam framework 1201 suitable for supporting and lifting the pallet bundle 412. The PSS 400 includes the pallet stack support mechanism 410 in which pallets are either accumulated from the EES 200 when vehicles are retrieved for a customer, and removed from the pallet bundle 412 for use in the EES 200 in preparation to receive a vehicle. The PSS 400 is constructed over a shuttle rail system 1200 that accommodates the pallet shuttle 250. The PVL 610 is suspended from the framework 1201 such that it can be lowered to either replace or remove the pallet stack 412 of the pallet stack support mechanism 410. Thus the PVL 610 operates over the height of several floors, in accordance with the particular garage design, such that when the pallet stack 412 is to be handled, the pallet stack 412 can be elevated to and from upper (or lower floors).

The PSS 400 includes the PVL motor 616 (e.g., an electromechanical motor) that operates in accordance with control signals from the central control system to either raise or lower the PVL 610 by driving a rotating shaft 1204 to take in or let out the PVL support 614 (i.e., a suspension means).

In operation, the pallet shuttle 250, when receiving control signals from the control system computer, traverses the shuttle rail system 1200 in a lateral (or x-axis) direction 1203 from the EES 200, and is positioned under any of the PSS 400 of the garage 100. The pallet shuttle 250 includes two pairs of steel shuttle wheels 1207 at each end that engage the shuttle rail system 1200. When bringing the pallet 212 to the PSS 400, the control system signals the pallet shuttle elevation mechanism 254 (not shown) contained in the pallet shuttle base 252 of the pallet shuttle 250 to lift the pallet shuttle support platform 256. The pallet shuttle support platform 256 is raised to a point such that the supported pallet 212 on the pallet shuttle support platform 256 contacts the lowest pallet of the pallet bundle 412, and continues rising forcing the pallet bundle 412 vertically to a height sufficient to allow the pallet stack support mechanism 410 to capture the pallet 212 by engaging the support latches 411. The pallet shuttle support platform 256 then lowers to a transport position such that the pallet shuttle 250 can traverse the shuttle rail system 1200 in accordance with instructions from the garage control system.

In a scenario where the pallet bundle 412 is removed from the PSS 400 for storage, the PVL 610 is controlled to lower about the pallet bundle 412. The tongs 612 are in an open stance for clearing the pallet bundle 412, and the PVL 610 is lowered to a point where the top edge 1206 of the tongs 612 is just lower than the bottom of the lowest pallet of the pallet bundle 412. The tongs 612 are then closed and secured for lifting the pallet bundle 412, after the pallet stack support mechanism 410 disengages the stack latches 411. The PVL 610 then rises to a floor predetermined by the garage control system. When brought into position at the designated floor, the PVL 610 is aligned at that floor such that the lower portion 1208 of the channel beam of the tongs 612 facilitates insertion of a REM (not shown) for removal of the pallet bundle 412 from the PVL 610. An upper carrier module (UCM) assembly (described in greater detail hereinbelow) that comprises the REM and UCM accesses the PVL 610 from a UCM rail system 1210 of that floor.

Figure 13:
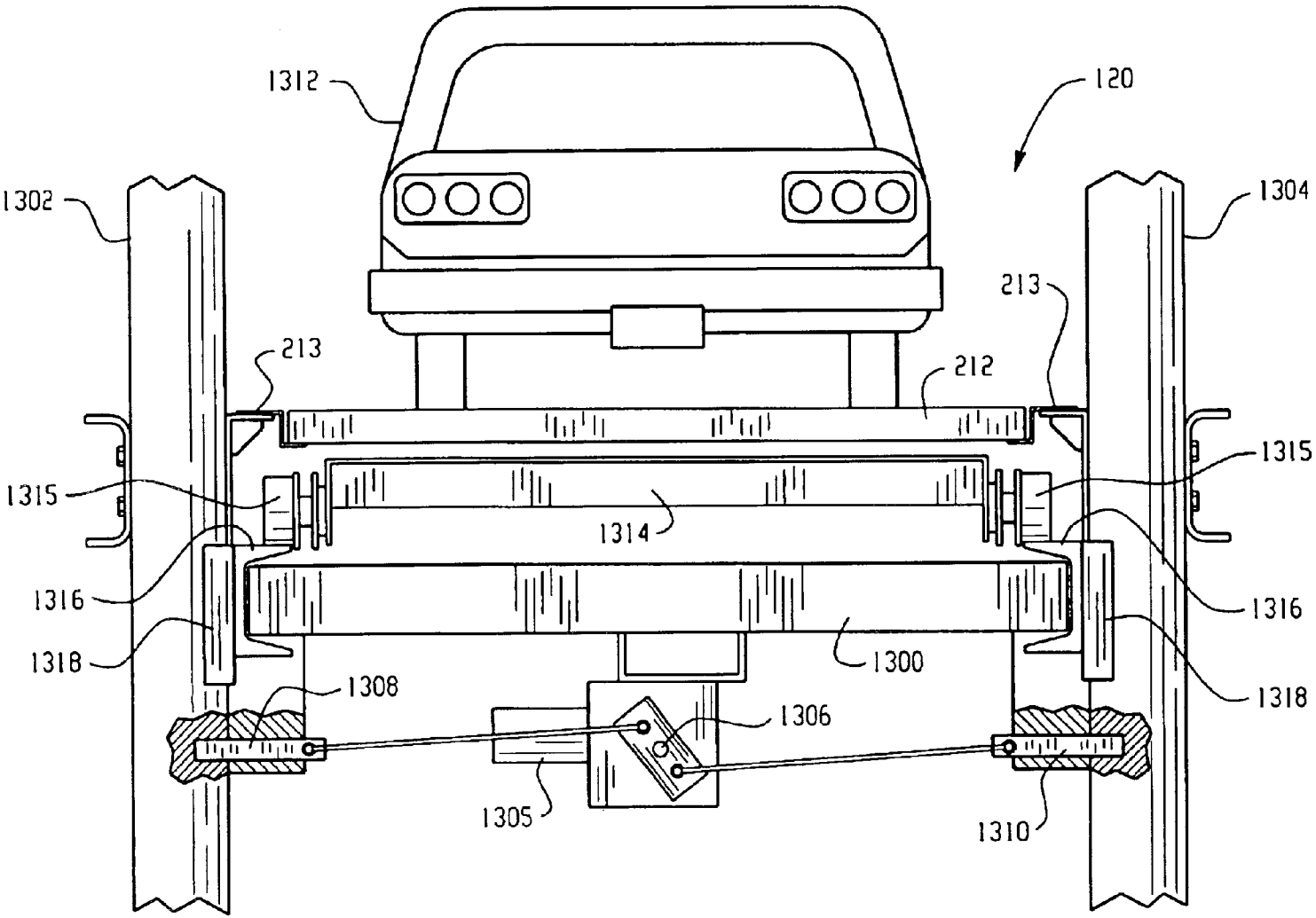
FIG. 13 illustrates an end view of the vertical lift conveyor (VLC) assembly.

Referring now to FIG. 13, there is illustrated an end view of the VLC assembly 120. As indicated hereinabove, the VLC assembly 120 operates to transport only loaded in the vertical (or z-axis) direction between the various floors of the garage 100. The VLC 120 is constructed within the steel girder structure of the garage 100 so that a carriage 1300 engages each of four beams at its corers when reaching the appropriate floor (or level). As illustrated, the unloaded carriage 1300 is positioned in a locking mode at a level of the garage 100 where one end of the carriage 1300 is positioned between two end girders (1302 and 1304). The carriage 1300 includes an electromechanical means 1305 that operates in accordance with control signals from the central control system to rotate a locking shaft 1306 to cause two pairs of opposing locking pins to engage the corner girders. Here, one pair of pins (1308 and 1310) is illustrated as engaged to respective corner girders (1302 and 1304). The electromechanical means 1305 connects to another shaft near the other end of the carriage 1300 to control locking pins at that end in a similar manner.

In this particular rendition, the VLC 120 is shown with a loaded pallet 212 (i.e., supporting a vehicle 1312). Note that the VLC 120 accommodates the loaded pallet 212 in the same way the pallet 212 is supported by the retractable pallet support mechanism 216 of FIG. 2, that is, by the pallet lips 213. The REM 1314 associated with the particular floor is shown inserted into that VLC 120 under the loaded pallet 212 such that the pallet 212 can be raised sufficiently to remove the loaded pallet 212 from the VLC 120 (for a removal operation). The REM 1314 includes the wheels 1315 for rolling the REM 1314 into the VLC 120 on VLC rails 1316. The carriage 1300 also includes corner assemblies 1318 at each corner thereof that connect to vertical lifting means (not shown), for example, chains, so that the carriage 1300 can be raised or lowered within the vertical shaft of the VLC 120 defined by the corner girders.

Figure 14:
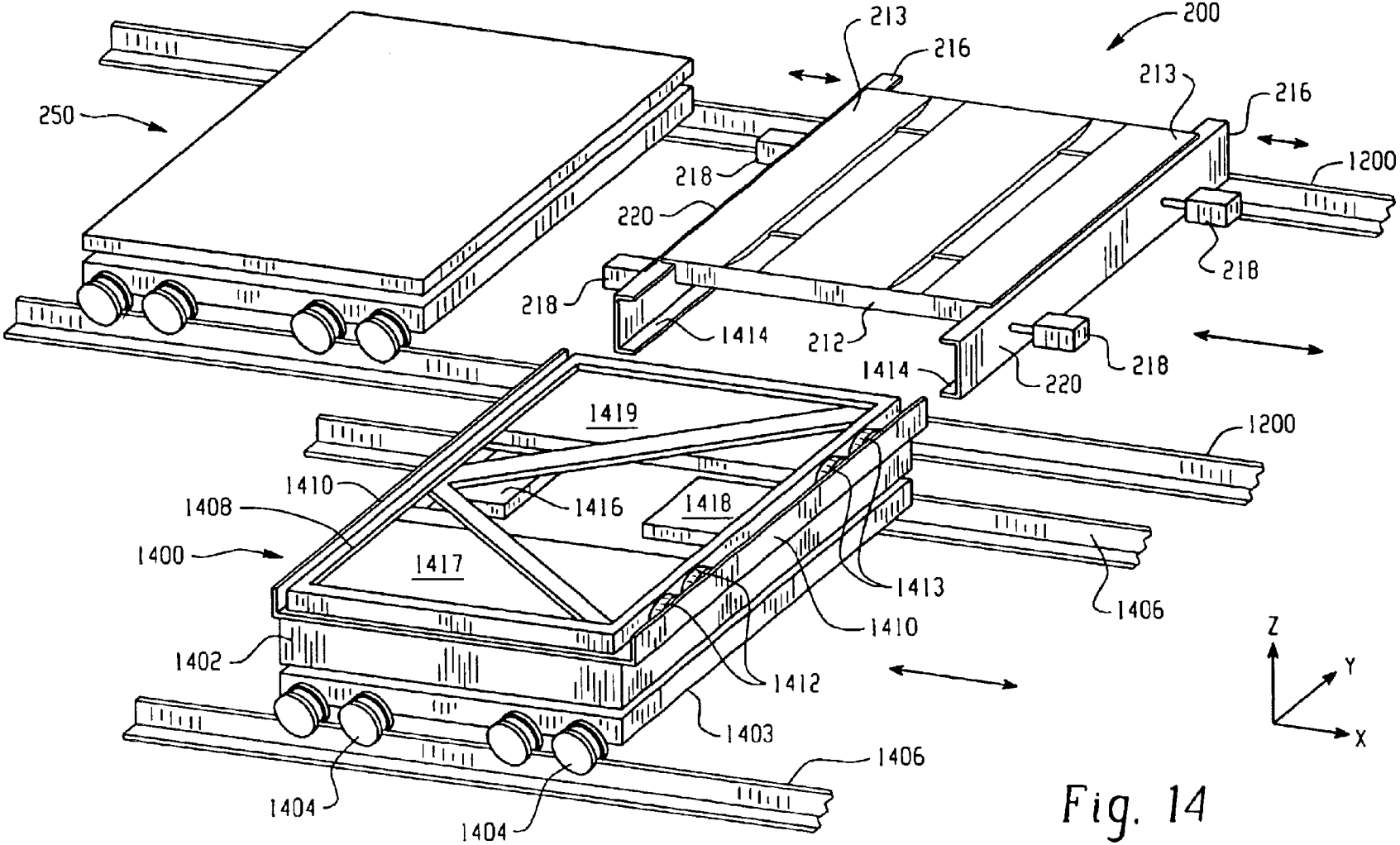
FIG. 14 illustrates a more detailed view of the mechanisms utilized for retrieving and replacing a pallet, loaded or unloaded, in the EES.

Referring now to FIG. 14, there is illustrated a more detailed view of the mechanisms utilized for retrieving and replacing a pallet, loaded or unloaded, in the EES 200. As illustrated, the unloaded pallet 212 is resting on the tracks 220 within the EES 200. The tracks 220 can be retracted utilizing a number of track retractors 218, which are electromechanical devices operating under control of the garage control system. That is, when the pallet 212 is to be retrieved from or returned to the PSS 400 (not shown), the track retractors 218 operate to spread the tracks 220 (along the x-axis) sufficiently so that the pallet 212 can be lowered downward (in the z-axis) by the pallet shuttle 250. Similarly, when the pallet 212 is being returned to the EES 200 from the PSS 400, and elevated from below into position such that the pallet lips 213 are just above the supporting surface of the tracks 220, the track retractors 218 operate to move the tracks 220 inward so that the pallet 212 can be lowered the short distance thereonto. Note the pallet shuttle 250 travels under the EES 200 on the shuttle rail system 1200, as indicated hereinabove. Note also that the PSS 400 need not be adjacent to the EES 200, since the shuttle rail system 1200 facilitates travel to virtually any location along the length of the garage 100.

When a customer has departed the EES 200, and initiated the parking procedure for a vehicle, a type of carrier module 110 utilized on the entrance level of the garage 100, denoted hereinafter as a lower carrier module (LCM) system 1400, is moved into alignment with the EES 200 by the garage control system. The LCM system 1400 includes an LCM turntable 1402 that rotates 180 degrees in a horizontal plane, a lower carrier 1403 having carrier wheels 1404 on each end that provide for traversing the length of the garage 100 (on the x-axis) on an LCM rail system 1406, and a lower rack entry module (REM) 1408 for insertion into the EES 200 (in the y-axis). Note that the number and orientation of the lower carrier wheels 1404 are such that at least one wheel 1404 of a pair is always in a supporting role of the lower carrier 1403 on the LCM rail system 1406.

The LCM turntable 1402 includes a rail (or wheel guide) 1410 on each side into which the wheels 1412 on either side of the lower carrier REM 1408 travel. The lower carrier REM rails 1410 of the LCM turntable 1402 are designed to align with a lower inside L-portion 1414 of the channel beams that function as the tracks 220 that support the loaded pallet 212 in the EES 200. The lower inside L-portion 1414 of each track 220 functions as a rail over which the wheels 1412 roll in order to position the lower carrier REM 1408 under the pallet 212. Note that the rails 1410 need not be in close proximity or direct contact with the corresponding lower inside L-portion 1414, since the REM wheels 1412 are grouped into pairs that are suitably spaced in a supporting role. If the loaded pallet 212 is selected for storage on the current floor, the LCM system 1400 moves to the designated storage slot 114, and the REM 1408 extends into either the interior storage rack 116 or fully to the exterior storage rack 118 to store the loaded pallet 212.

Alternatively, if the garage control system directs that the loaded pallet 212 is to be stored on a different floor, the LCM system 1400 and loaded pallet 212 move to the VLC 120 (not shown) where the loaded pallet 212 is placed into the VLC 120 for vertical movement to the other floor.

The lower carrier REM 1408 of the LCM system 1400 includes a lower REM control means 1416 that communicates with the garage control system to process signals that control functions of the lower carrier REM 1408, including movement into and out of the EES 200 and elevation of an elevating means. The lower REM control means 1416 connects electrically to a first wheel drive section 1417, which first wheel drive section 1417 includes the following general components (that are not illustrated here, but are shown in greater detail in FIG. 17): a first drive means, a first transfer means, and a first set of four wheels 1412 with a pair located on each side and near the end of the REM chassis. The lower REM control means 1416 also connects electrically to a second wheel drive section 1419, which second wheel drive section 1419 includes a second drive means, a second transfer means, and a second set of four wheels 1413 with a pair located on each side and near the opposite end of the REM chassis. The first and second drive means may be one or more electromechanical motors that drive the wheels (1412 and 1413) so that the lower carrier REM 1408 moves along the y-axis into and out of the tracks 220 of the EES 200. The first and second transfer means that transfer the drive torque from the first (and second) drive means to the wheels 1412 (and 1413) can include any combination of conventional equipment such as shafts, gears, belts and pulleys, or chains that suitably designed into the lower carrier REM 1408 to facilitate such functions.

The lower REM 1408 also includes a lower REM elevator motive means 1418 under control of the lower REM control means 1416 so that an elevator component (not shown) of the lower REM 1408 can be raised to support the loaded or unloaded pallet 212 in the EES 200, and lowered for transport of the pallet and/or vehicle along the LCM rail system 1406. The elevator component comprises a platform for mating with the underside of the pallet 212 to prevent shifting of the pallet 212 during transport. The lower REM elevator motive means 1418 includes one or more electric motors of sufficient operating parameters to drive raising and lowering of the pallet 212 when loaded. The elevator component can include several screw jacks, screw actuators, or similar means that connect to the lower REM elevator motive means 1418 to facilitate the elevating process of the lower carrier REM 1408.

The lower carrier 1403 also includes a lower carrier control means (not shown) in communication with the garage control system, and a lower carrier drive means (not shown) both of which facilitate operation thereof along the LCM rail system 1406 to position the LCM 1400 in alignment with the tracks 220. Once aligned, the lower carrier REM 1408 moves along the tracks 220 under the pallet 212, and raises the pallet 212 sufficiently to clear the tracks 220, and exits the EES 200 back onto the LCM 1402 with the pallet 212. Of course, the lower carrier REM 1408 is of a width that allows it to be elevated between the tracks 220 when the tracks are closed in a supporting role, to support the pallet 212 for removal from the EES 200. As described, the track retractors 218 need not be operated when removing or retrieving a loaded pallet 212 from the EES 200.

Note that LCM assembly 1400 is only operable on the entrance level floor, while the UCM assembly operates on any floor other than the entrance level floor. Floors other than the entrance level floor have only a fraction of the vehicle-handling load performed on the entrance floor. Thus the UCM assembly is more often available to move the pallet bundle 412 in and out of the PVL 610, and into and out of storage slots on those floors. The VLC 120 and LCM assembly 1400 preferably are never utilized to handle pallet bundles 412 or an empty pallet; these machines should only handle loaded pallets. The UCM assemblies handle only a portion of the vehicles depending on the number of floors in the garage 100.

Figure 15:
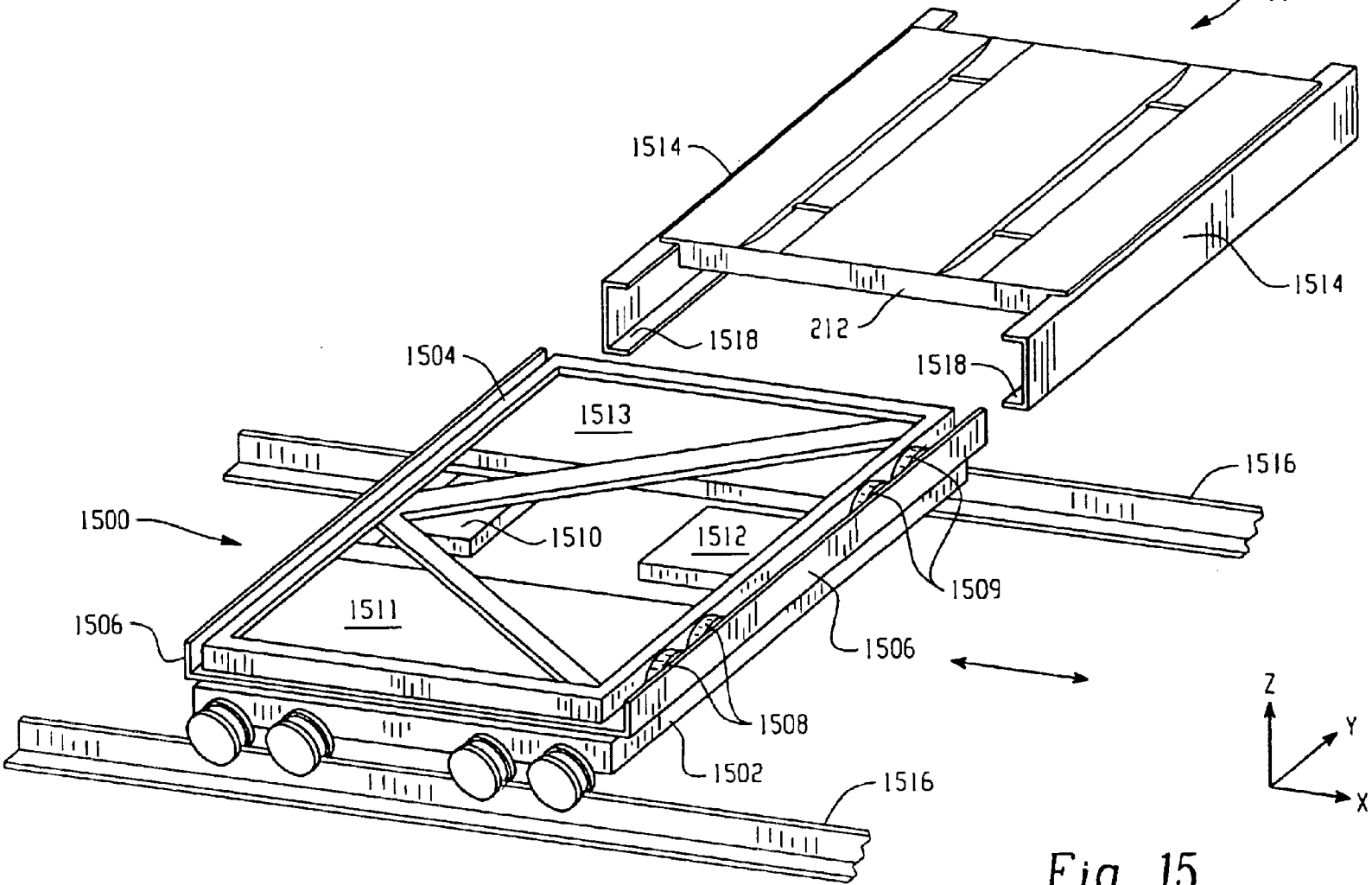
FIG. 15 illustrates a more detailed view of the carrier module utilized in the levels of the garage other than the entrance level.

Referring now to FIG. 15, there is illustrated the carrier module 110 utilized in the levels of the garage 100 other than the entrance level, and hereinafter denoted specifically as an upper carrier module (UCM) assembly 1500. The UCM assembly 1500 includes an upper carrier 1502 and an upper carrier REM 1504 (similar to lower carrier REM 1408). The upper carrier 1502 is similar to the lower carrier 1403 of the LCM system 1400, except that the upper carrier 1502 includes upper carrier rails (or wheel guides, similar to the rails 1410 of the LCM system 1400) 1506 within which wheels 1508 (similar to the wheels 1412 of the lower carrier REM 1408 of the LCM system 1400) situated on either side of the upper carrier REM 1504 travel to facilitate movement of the upper carrier REM 1504 along the y-axis. Thus generally, the only difference between the LCM assembly 1400 and the UCM assembly 1500 is that the LCM assembly 1400 includes the LCM turntable 1402 with the rails 1410, and the UCM assembly 1500 includes the upper carrier 1502 with the rails 1506, but not turntable feature. The UCM system 1500 includes an upper REM control means 1510 and an upper REM motive means 1512, both of which provide similar functions as the corresponding control means 1416 and motive means 1418 of the lower carrier REM 1408.

The upper REM control means 1510 communicates with the garage control system to process signals that control functions of the upper carrier REM 1504, including movement into and out of the storage slot 114 (extending across the interior storage rack 116 to the exterior storage rack 118) and elevation of an elevating means. The upper REM control means 1510 connects electrically to a first wheel drive section 1511, which first wheel drive section 1511 includes the following general components (that are not illustrated here, but are shown in greater detail in FIG. 17): a first drive means, a first transfer means, and a first set of four wheels 1508 with a pair located on each side and near the end of the upper carrier REM chassis. The upper REM control means 1510 also connects electrically to a second wheel drive section 1513, which second wheel drive section 1513 includes a second drive means, a second transfer means, and a second set of four wheels 1509 with a pair located on each side and near the opposite end of the upper carrier REM chassis. The first and second drive means may be one or more electromechanical motors that drive the wheels (1508 and 1509) so that the upper carrier REM 1504 moves along the y-axis into and out of tracks 1514 of the storage slot 114. The first and second transfer means that transfer the drive torque from the first (and second) drive means to the wheels 1508 (and 1509) can include any combination of conventional equipment such as shafts, gears, belts and pulleys, or chains that suitably designed into the upper carrier REM 1504 to facilitate such functions.

The upper carrier REM 1504 also includes an upper REM elevator motive means 1512 under control of the upper REM control means 1510 so that an elevator component (not shown) of the upper carrier REM 1504 can be raised or lowered while supporting the loaded or unloaded pallet 212, and further lowered for transport of the pallet 212 and/or vehicle along a UCM rail system 1516. The elevator component comprises a platform for mating with the underside of the pallet 212 to prevent shifting of the pallet 212 during transport. The upper carrier REM elevator motive means 1512 includes one or more electric motors of sufficient operating parameters to drive the raising and lowering of the pallet 212 when loaded. The elevator component can include several screw jacks that connect to the upper carrier REM elevator motive means 1512 to facilitate the elevating process of the upper carrier REM 1504. The upper carrier 1502 includes similar arrangements, e.g., a control box, drive sets, etc., to move in the x-axis along the aisles of the associated floors.

In this particular scenario, the unloaded pallet 212 is stored in one of the many vehicle storage slots 114 of the upper (or lower) levels of the garage 100. Thus the storage slot 114 includes the support beams 1514 that are fixed within the garage structure. Similar to the LCM system 1400 mentioned hereinabove, the UCM system 1500 operates over the UCM rail system 1516 extending essentially the length of the garage 100. Each level includes a single UCM rail system 1516 and one or more UCM systems 1500 operating independently under control of the garage control system to retrieve or store loaded and unloaded pallets 212.

In operation, the UCM system 1500 moves into alignment with the storage slot 114 under control of the garage control system. The alignment process is similar to that of the LCM system 1400 such that the upper carrier wheel guides 1506 are aligned with a lower L-portion 1518 of the corresponding support beams 1514. The upper carrier REM 1504 is then controlled to move onto the lower L-portion of the support beams 1514 in a position under the pallet 212. The carrier module 1502 remains in alignment position while the upper carrier REM 1504 elevates to support the pallet 212. The upper carrier REM 1504 is then controlled to return onto the upper carrier 1502. Similar to operation of the lower carrier REM 1408, upon return, the upper carrier REM 1504 lowers back to a more stable position onto the upper carrier 1502 for transport of the pallet 212 to one of the several VLCs 120.

Figure 16:
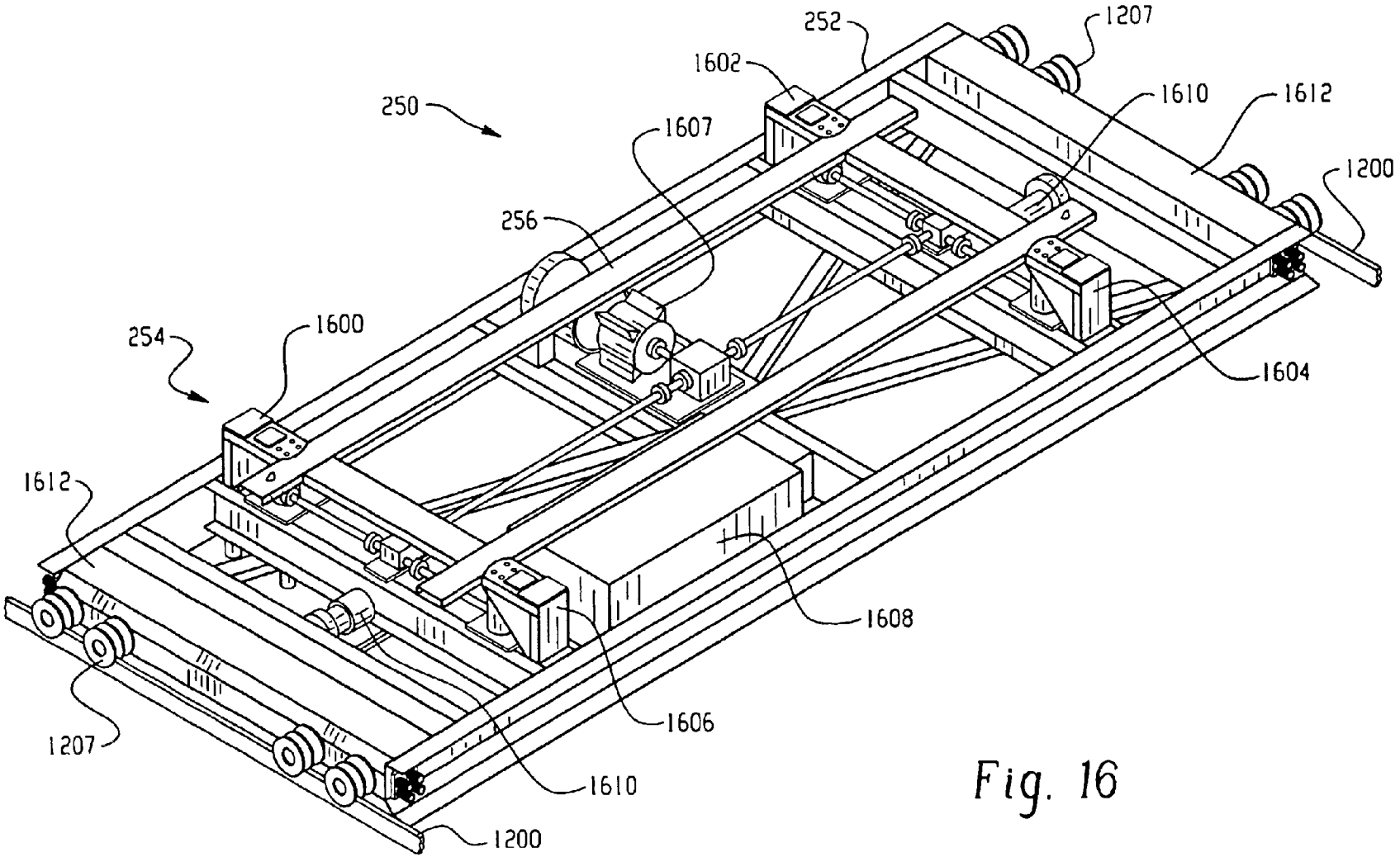
FIG. 16 illustrates a more detailed mechanical view of the pallet shuttle.

Referring now to FIG. 16, there is illustrated a more detailed mechanical view of the pallet shuttle 250. As indicated hereinabove, the pallet shuttle 250 comprises the pallet shuttle base 252, the pallet shuttle elevation mechanism 254, and pallet shuttle support platform 256. The pallet shuttle base 252 includes the shuttle wheels 1207 on each end that are in rolling contact with the shuttle rail system 1200. The pallet shuttle elevation mechanism 254 comprises four mechanical screw actuators (1600, 1602, 1604, and 1606) that operate from an elevation drive means 1607 that is under the coordinated control of a shuttle control means 1608, which shuttle control means 1608 communicates with the garage control system at the control room 126 to facilitate operation of the pallet shuttle 250. The pallet shuttle elevation mechanism 254 elevates between the tracks 220 when in the EES 200 to position sufficient to support the unloaded pallet so that the tracks 220 can be retracted (or spread apart) by the track retractors 218. When operating with the PSS 400, the pallet shuttle elevation mechanism 254 elevates to a position sufficient to support all of the pallets 212 currently stored in the PSS 400, and where stack latches 411 of the pallet stack support mechanism 410 can then move to support a portion of the bottom pallet of the stack of pallets 412.

The pallet shuttle base 252 includes one or more shuttle drive means 1610 (e.g., electric motors) for driving the wheels 1207 to travel along the shuttle rail system 1200, and to lock into position the pallet shuttle 250 when vertically aligned under the EES 200 or any of the PCC 400 locations to handle the pallet 212. The drive means 1610 couple to corresponding gear boxes 1612 in which transfer equipment resides to couple the drive means 1610 to the corresponding wheel sets 1207. As indicated hereinabove, such transfer equipment can include belts, pulleys, gears, chains, and shafts as used conventionally with such equipment.

Figure 17:
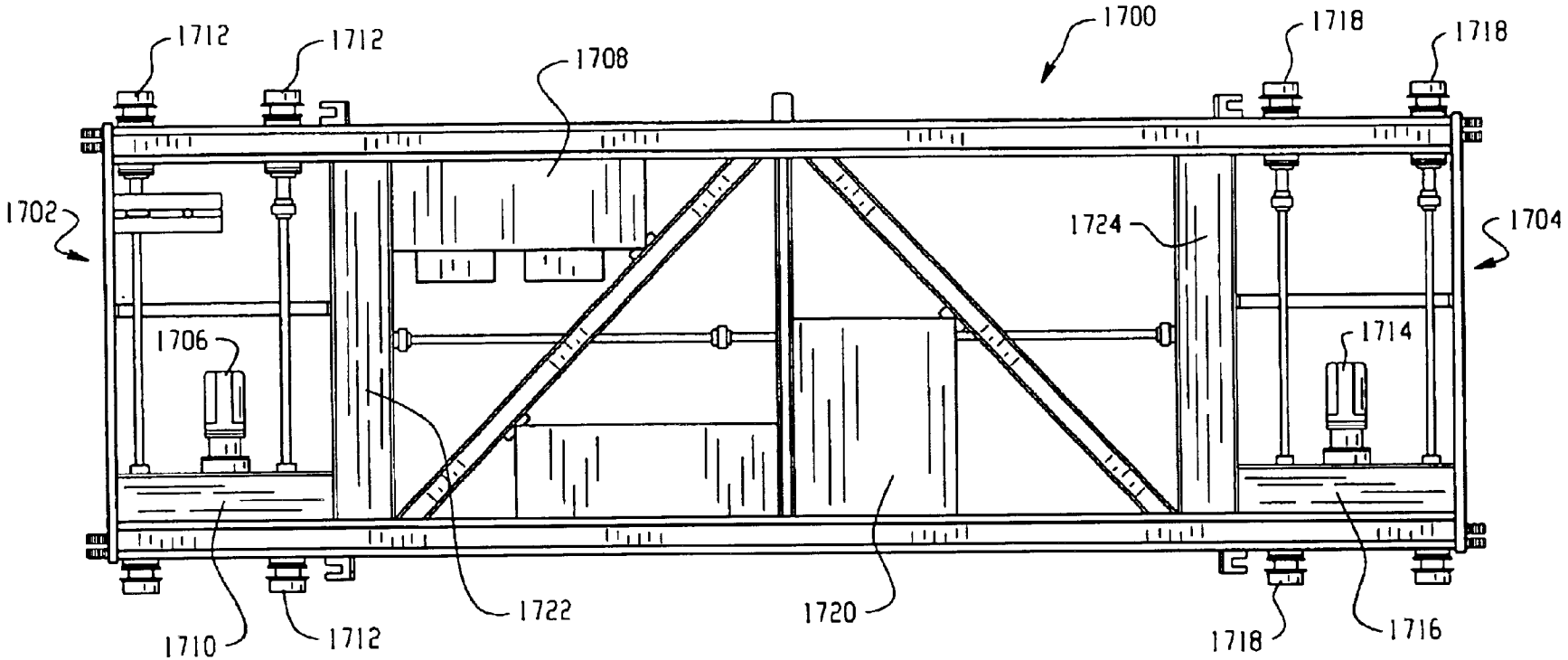
FIG. 17 illustrates a more detailed mechanical view of a REM.

Referring now to FIG. 17, there is illustrated a more detailed mechanical view of a REM 1700 (similar to lower carrier REM 1408 and upper carrier REM 1504). The REM 1700 includes a first wheel drive section 1702 and a second wheel drive section 1704. The first wheel drive section 1702 includes a first wheel drive means 1706 (e.g., an electromechanical motor) that operates under control of a REM control means 1708 (similar to lower carrier control means 1416 and upper carrier control means 1510). The first wheel drive means 1706 is mounted to a first transfer means 1710 such that torque provided therefrom is transferred to the wheels 1712 associated with the first wheel drive section 1702. As indicated hereinabove, such transfer is suitably provided by conventional mechanisms such as belts and pulleys, gears, chains and/or shafts.

Similarly, the second wheel drive section 1704 includes a second wheel drive means 1714 (e.g., an electromechanical motor) that operates under control of the REM control means 1708. The second wheel drive means 1714 is mounted to a second transfer means 1716 such that torque provided therefrom is transferred to the wheels 1718 associated with the second wheel drive section 1704. Note that the first and second drive means (1706 and 1714) are operated synchronously by the REM control means 1708. However, it is appreciated that the first and second drive means (1706 and 1714) may also be operated independent of one another, which provides a back-up feature if one of the drive means (1706 or 1714) should fail.

The REM 1700 also includes an elevator motive means 1720 under control of the REM control means 1708 so that an elevator component (not shown) can be raised or lowered while supporting the loaded or unloaded pallet 212, and further lowered for transport of the pallet 212 and/or vehicle. The elevator component comprises a platform for mating with the underside of the pallet 212 to prevent shifting of the pallet 212 during transport. The REM elevator motive means 1720 includes one or more electric motors of sufficient operating parameters to drive the raising and lowering of the pallet 212 when loaded. The elevator component can include several screw actuators or similar means located in elevator gear boxes (1722 and 1724), and that connect to the REM elevator motive means 1720 to facilitate the elevating process.

Note that all vehicle storage operations in the storage area of the garage 100 (i.e., the area of vehicle storage racks) and handling of loaded pallets to and from the EES, can be generalized as being accomplished by a transport system, which transport system includes the VLC assembly 120, the LCM system 1400, UCM assembly 1500, carrier aisle systems, etc., although the UCM can be used to handle pallet bundles 412, which of course, are unloaded pallets. As mentioned hereinabove, the PSS 400 handles only unloaded pallets.

Since the garage 100 includes a number of upper and lower module systems (1400 and 1500) operating independently under control of the garage control system on various levels, it is appreciated that communication from the garage control system to the module systems (1400 and 1500) is preferably, but not necessarily, wireless to preclude the need for large wiring harness and extensive routings of cable suspended throughout the garage structure. Thus each module system (1400 and 1500) would communicate wirelessly with the garage control system via a unique frequency.

Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A method of providing an automated parking garage, comprising:

providing a multi-floor building having a plurality of vehicle storage racks in a storage area for storing a loaded pallet or an unloaded pallet;

providing an entry/exit station (EES) on an entrance-level floor of the building for receiving a vehicle, the EES having an exterior entrance through which the vehicle is driven and, an opposing interior entrance that provides access to the storage area and through which the loaded pallet is transported, the loaded pallet and unloaded pallet adapted to be positioned at floor level in the EES;

storing the unloaded pallet in a pallet stacking station, the pallet stacking station located over a shuttle aisle that extends under the EES;

moving a pallet shuttle along the shuttle aisle to a first position under the EES for handling the unloaded pallet in the EES, and to a second position under the pallet stacking station for stacking the unloaded pallet; and transporting with a transport system the loaded pallet in the storage area, wherein the transport system comprises a lower carrier assembly on the entrance-level floor that includes a turntable that rotates the loaded pallet in a horizontal plane once in the storage area.

2. The method of claim 1, wherein the plurality of vehicle storage racks include a first vehicle storage rack and a second vehicle storage rack that are aligned end-to-end such that the transport system operates to access the second vehicle storage rack through the first vehicle storage rack.

3. The method of claim 1, wherein the transport system in the step of transporting includes a vertical lift conveyor that transports the loaded pallet vertically between floors of the multi-floor building.

4. The method of claim 1, wherein the transport system in the step of transporting includes a lower carrier assembly that extends into the EES to handle the loaded pallet.

5. The method of claim 1, wherein each floor of the multi-floor building includes a carrier aisle over which at least one carrier assembly traverses to access each of the vehicle storage racks thereon.

6. The method of claim 1, wherein the transport system in the step of transporting includes a vertical lift conveyor that transports the loaded pallet vertically between floors of the multi-floor building and a carrier assembly that traverses the horizontal length of a floor, such that vertical lift conveyor has associated therewith a vehicle storage rack that is accessible by the carrier assembly only through the vertical lift conveyor.

7. The method of claim 1, wherein the EES includes a pallet support mechanism that operates in one of a support position and a non-support position such that when the unloaded pallet is removed from the EES to the pallet stacking station, the pallet shuttle traverses to the first position under the EES and operates a pallet shuttle elevation mechanism of the pallet shuttle to raise the unloaded pallet from underneath so that the pallet support mechanism can be operated to the non-support position.

8. The method of claim 1, wherein the pallet stacking station in the step of storing includes a pallet vertical lift that performs one of vertically transporting a pallet bundle from a non-entrance-level floor to a pallet stack support mechanism of the pallet stacking station, and from the pallet stack support mechanism to the non-entrance-level floor.

9. The method of claim 8, wherein the pallet stacking station in the step of storing further comprises:

tongs for supporting at least one pallet;

a tong controller operatively attached to the tongs for controlling the tongs in both an open position and a closed position;

a tong suspension system for suspending the tongs; and a vertical lift motive means for elevating the tongs relative to the pallet stacking station.

10. The method of claim 1, wherein a customer initiates storage of the loaded pallet with the transport system via an automated parking teller associated with and located outside of the EES in which a vehicle of the customer entered.

11. The method of claim 10, wherein the automated parking teller communicates with a garage control system such that in response to the customer conducting a transaction thereof, the garage control system closes an exterior door of the exterior entrance of the EES and opens an interior door of the interior entrance of the EES.

12. The method of claim 1, wherein the EES includes a first retractable pallet support mechanism operative in a support position and a retracted position, which the support position supports both the loaded and unloaded pallet, and which retracted position facilitates the transfer of support to the pallet shuttle in the step of moving.

13. The method of claim 1, wherein the transport system in the step of transporting includes a lower carrier assembly and an upper carrier assembly, each of which includes a rack entry module that extends therefrom, such that the rack entry module of the lower carrier assembly extends horizontally into at least one of the EES, a vertical lift conveyor, and the plurality of storage racks, and the rack entry module of the upper carrier module extends into the plurality of storage racks and the vertical lift conveyor.

14. The method of claim 13, wherein the rack entry module raises and lowers the loaded pallet.

15. The method of claim 1, wherein the pallet stacking station in the step of storing operates to release the unloaded pallet to the pallet shuttle and retrieve the unloaded pallet from the pallet shuttle.

16. The method of claim 1, wherein the pallet stacking station in the step of storing operates to release the unloaded pallet to the pallet shuttle from the bottom of a pallet bundle and retrieve the unloaded pallet from the pallet shuttle to the bottom of the pallet bundle.

17. The method of claim 1, wherein the transport system in the step of transporting includes an upper carrier assembly for a non-entrance-level floor of the multi-floor building, which non-entrance-level floor is other than the entrance-level floor, such that the upper carrier assembly traverses the non-entrance-level floor to access at least one of storage racks associated therewith and a vertical lift conveyor.

18. The method of claim 1, wherein the transport system in the step of transporting includes a plurality of upper carrier assemblies for each non-entrance-level floor of the multi-floor building, which non-entrance-level floor is other than the entrance-level floor, such that the plurality of upper carrier assemblies traverse the non-entrance level floor to access at least one of the plurality of storage racks associated therewith and a vertical lift conveyor.

19. The method of claim 18, wherein the plurality of upper carrier assemblies for a given non-entrance-level floor operate independently and overlappingly.

20. The method of claim 1, wherein the transport system in the step of transporting includes a lower carrier assembly for the entrance-level floor such that the lower carrier assembly traverses the entrance-level floor to access at least one of storage racks, a vertical lift conveyor, and the EES.

21. The method of claim 1, wherein the transport system in the step of transporting includes a plurality of lower carrier assemblies for the entrance-level floor such that the plurality of lower carrier assemblies traverse the entrance-level floor to access at least one of storage racks, a vertical lift conveyor, and the EES.

22. The method of claim 21, wherein the plurality of lower carrier assemblies for the entrance-level floor operate independently and overlappingly.

23. The method of claim 21, wherein the plurality of lower carrier assemblies only transport loaded pallets.

24. The method of claim 1, wherein the garage includes a plurality of the EES on the entrance-level floor, and a plurality of the pallet shuttles, which the plurality of the pallet shuttles traverse the shuttle aisle to access selected ones of the plurality of the EES.

25. The method of claim 24, wherein each of the plurality of the pallet shuttles operate independently and overlappingly.

26. A method of parking in an automated parking garage, comprising the steps of:

providing a multi-floor building having a plurality of vehicle storage racks in a storage area for storing a loaded pallet or an unloaded pallet;

providing an entry/exit station (EES) on an entrance-level floor of the building for receiving a vehicle, the EES having an exterior entrance through which the vehicle is driven and, an opposing interior entrance that provides access to the storage area and through which the loaded pallet is transported, the loaded pallet and unloaded pallet adapted to be positioned at floor level in the EES;

transporting the loaded pallet in the storage area with a transport system, which transport system includes:

a lower carrier assembly movable over a lower carrier aisle for removing from and inserting into the EES the loaded pallet, including a turntable that rotates the loaded pallet in a horizontal plane once in the storage area, a vertical lift conveyor that interfaces with the lower carrier assembly and conveys the loaded pallet vertically between the entrance-level floor and a non-entrance-level floor, and an upper carrier assembly movable over an upper carrier aisle of the non-entrance-level floor that interfaces with the vertical lift conveyor and transports the loaded pallet between the vertical lift conveyor and a storage rack, maintaining the unloaded pallet for use in the EES with a pallet stacking station, which pallet stacking station includes:

a pallet vertical lift for vertically processing the unloaded pallet, and a pallet stack support mechanism for supporting the unloaded pallet, and moving a pallet shuttle over a shuttle aisle to a first position under the EES and to a second position under the pallet stacking station, which pallet shuttle traverses the shuttle aisle to facilitate transportation of the unloaded pallet therebetween.

27. The method of claim 26, wherein the pallet shuttle in the step of moving moves to the first position under the EES and elevates the unloaded pallet to a predetermined vertical position within the confines of a pallet support mechanism of the EES, which pallet support mechanism closes to capture the unloaded pallet in a supporting position.

28. The method of claim 26, wherein the pallet shuttle in the step of moving moves to the second position under the pallet stacking station and elevates the unloaded pallet to a predetermined vertical position of the pallet stack support mechanism, which pallet vertical lift then captures the unloaded pallet in a supporting position.

29. The method of claim 26, wherein the pallet vertical lift in the step of maintaining captures and elevates at least one unloaded pallet from the pallet stack support mechanism and transports the at least one unloaded pallet to a non-entrance-level floor for storage.

* * * * *